US008632417B2

(12) United States Patent
Sander et al.

(10) Patent No.: US 8,632,417 B2
(45) **Date of Patent: *Jan. 21, 2014**

(54) RELEASABLE AND INTERCHANGEABLE CONNECTIONS FOR GOLF CLUB HEADS AND SHAFTS

(75) Inventors: Raymond J. Sander, Benbrook, TX (US); Joshua Michael Boggs, New Albany, OH (US); Sherry Lynn Jones, Pataskala, OH (US); Joseph M. Lehman, New Albany, OH (US); Daniel Francis Wisniewski, Columbus, OH (US)

(73) Assignee: Nike, Inc., Beaverton, OR (US)

( * ) Notice: Subject to any disclaimer, the term of this patent is extended or adjusted under 35 U.S.C. 154(b) by 253 days.

This patent is subject to a terminal disclaimer.

(21) Appl. No.: 13/030,838

(22) Filed: Feb. 18, 2011

(65) Prior Publication Data

US 2011/0195798 A1 Aug. 11, 2011

Related U.S. Application Data

(63) Continuation-in-part of application No. 11/846,370, filed on Aug. 28, 2007.

(51) Int. Cl.
*A63B 53/02* (2006.01)

(52) U.S. Cl.
USPC ..... 473/307; 473/288; 473/248; 473/309

(58) Field of Classification Search
USPC ..... 473/305–312, 288, 298–299, 296, 473/245–246, 248
See application file for complete search history.

(56) References Cited

U.S. PATENT DOCUMENTS

| | | | |
|---|---|---|---|
| 1,266,529 | A | 5/1918 | Mattern |
| 1,792,852 | A | 12/1926 | Mattern |
| 1,623,523 | A | 4/1927 | Bourke |

(Continued)

FOREIGN PATENT DOCUMENTS

| | | |
|---|---|---|
| GB | 392493 | 5/1933 |
| GB | 443439 | 2/1936 |

(Continued)

OTHER PUBLICATIONS

Korean Office Action corresponding to Korean Application No. 10-2010-7005698; dated Dec. 5, 2011.

(Continued)

*Primary Examiner* — Stephen L. Blau
(74) *Attorney, Agent, or Firm* — Banner & Witcoff, Ltd.

(57) ABSTRACT

Golf club heads are releasably engaged with shafts so that the club heads and shafts can be readily interchanged and/or so that the shaft position with respect to the club head can be readily changed. Assemblies for connecting the club head and shaft may include: (a) a first cylindrical structure having a cylindrical interior chamber for receiving a golf club shaft, a first rotation-inhibiting structure, and a securing structure; (b) a second cylindrical structure having a borehole for receiving the first cylindrical structure, and a second rotation-inhibiting structure that engages the first rotation-inhibiting structure and (c) a securing system for releasably engaging the securing structure. The shaft may extend at an angle from the shaft connection assembly so as to allow adjustment of the shaft position with respect to the club head by rotating the first cylindrical structure or exchanging the second cylindrical structure.

18 Claims, 20 Drawing Sheets

(56) References Cited

U.S. PATENT DOCUMENTS

| | | | | |
|---|---|---|---|---|
| 1,634,082 | A | 6/1927 | Rigby | |
| 1,850,843 | A | 3/1932 | Lagerblade | |
| 2,067,556 | A | 1/1937 | Wettlaufer | |
| 2,219,670 | A | 10/1940 | Wettlaufer | |
| 2,451,262 | A | 10/1948 | Watkins | |
| 2,464,850 | A | 3/1949 | Crawshaw | |
| 3,206,206 | A | 9/1965 | Santosuosso | |
| 3,516,697 | A | 6/1970 | Hahn | |
| 3,524,646 | A | 8/1970 | Wheeler | |
| 3,656,366 | A | 4/1972 | Somero | |
| 3,848,737 | A | 11/1974 | Kenon | |
| 3,891,212 | A | 6/1975 | Hill | |
| 4,253,666 | A | 3/1981 | Murphy | |
| 4,340,227 | A | 7/1982 | Dopkowski | |
| 4,664,382 | A | 5/1987 | Palmer et al. | |
| 4,948,132 | A * | 8/1990 | Wharton | 473/246 |
| 4,984,794 | A | 1/1991 | Pernelle et al. | |
| 5,165,688 | A | 11/1992 | Schmidt | |
| 5,232,224 | A | 8/1993 | Zeider | |
| 5,275,399 | A | 1/1994 | Schmidt | |
| 5,275,408 | A | 1/1994 | Desbiolles et al. | |
| 5,429,355 | A | 7/1995 | Schmidt | |
| 5,433,442 | A | 7/1995 | Walker | |
| 5,577,726 | A | 11/1996 | Fenton | |
| 5,588,921 | A | 12/1996 | Parsick | |
| 5,626,528 | A | 5/1997 | Toulon | |
| 5,839,973 | A | 11/1998 | Jackson | |
| 5,851,155 | A | 12/1998 | Wood et al. | |
| 5,855,526 | A | 1/1999 | Honma | |
| 5,906,549 | A | 5/1999 | Kubica | |
| 6,095,929 | A | 8/2000 | Clark | |
| 6,149,533 | A | 11/2000 | Finn | |
| 6,203,443 | B1 | 3/2001 | Britton | |
| 6,251,028 | B1 | 6/2001 | Jackson | |
| 6,270,425 | B1 | 8/2001 | Dyer | |
| 6,273,828 | B1 | 8/2001 | Wood et al. | |
| 6,287,215 | B1 | 9/2001 | Fisher | |
| 6,319,146 | B1 | 11/2001 | Mills | |
| 6,332,945 | B1 | 12/2001 | Lenhof | |
| 6,368,230 | B1 | 4/2002 | Helmstetter et al. | |
| 6,447,404 | B1 | 9/2002 | Wilbur | |
| 6,508,288 | B2 | 1/2003 | Lenhof | |
| 6,547,673 | B2 | 4/2003 | Roark | |
| 6,652,388 | B1 | 11/2003 | Lenhof | |
| 6,669,573 | B2 | 12/2003 | Wood et al. | |
| 6,797,106 | B2 | 9/2004 | Lenhof | |
| 6,890,269 | B2 * | 5/2005 | Burrows | 473/307 |
| 7,017,252 | B2 | 3/2006 | Lenhof | |
| 7,083,529 | B2 | 8/2006 | Cackett | |
| 7,115,046 | B1 | 10/2006 | Evans | |
| 7,300,359 | B2 | 11/2007 | Hocknell | |
| 7,326,126 | B2 | 2/2008 | Holt | |
| 7,335,113 | B2 | 2/2008 | Hocknell | |
| 7,344,449 | B2 | 3/2008 | Hocknell | |
| 7,476,160 | B2 * | 1/2009 | Hocknell et al. | 473/307 |
| 7,976,401 | B2 * | 7/2011 | Sato et al. | 473/288 |
| 8,246,484 | B2 * | 8/2012 | Sato et al. | 473/307 |
| 8,303,431 | B2 * | 11/2012 | Beach et al. | 473/307 |
| 2002/0037773 | A1 | 3/2002 | Wood et al. | |
| 2006/0293116 | A1 | 12/2006 | Hocknell et al. | |
| 2008/0051211 | A1 | 2/2008 | Hocknell | |
| 2008/0058114 | A1 | 3/2008 | Hocknell | |
| 2008/0070717 | A1 | 3/2008 | Hocknell | |
| 2008/0280693 | A1 | 11/2008 | Chai | |
| 2009/0264214 | A1 | 10/2009 | De La Cruz et al. | |
| 2009/0286618 | A1 | 11/2009 | Beach et al. | |
| 2011/0098127 | A1 | 4/2011 | Yamamoto | |

FOREIGN PATENT DOCUMENTS

| | | |
|---|---|---|
| GB | 2331464 | 5/1999 |
| JP | 2000024143 | 1/2000 |
| JP | 2006-42951 A * | 2/2006 |
| JP | 2006042951 | 4/2009 |
| WO | 9000424 | 1/1990 |
| WO | 2007022671 | 3/2007 |
| WO | 2009/035345 | 3/2009 |

OTHER PUBLICATIONS

Canadian Office Action corresponding to Canadian Application No. 2,696,921; dated Aug. 9, 2011.

International Search Report in related International PCT Application No. PCT/US2012/023237; dated Jul. 26, 2012.

Canadian Office Action in related Canadian Application No. 2,696,921; dated May 23, 2012.

European Search Report from European Patent Application No. 03748963.0, dated Apr. 7, 2008.

International Search Report in corresponding PCT Application, International Application No. PCT/US2008/073703, mailed Jan. 21, 2009.

Japanese Office Action from Japanese Patent Application No. 2010-523038; dispatch date: Nov. 28, 2012.

* cited by examiner

RELEASABLE AND INTERCHANGEABLE CONNECTIONS FOR GOLF CLUB HEADS AND SHAFTS

RELATED APPLICATIONS

This application is a continuation-in-part application of U.S. patent application Ser. No. 11/846,370 filed Aug. 28, 2007, which is hereby incorporated by reference in its entirety.

FIELD OF THE INVENTION

This invention relates generally to golf clubs and golf club heads. More particularly, aspects of this invention relate to golf clubs having releasable connections between the golf club head and the shaft and/or head/shaft position adjusting features to allow easy interchange of shafts and heads and/or to allow easy modification of the head/shaft positioning properties.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, face angle, offset features, weighting characteristics, etc. (e.g., including draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc. Many different grip variations and models also are now available on the market. Between the available variations in grips, shafts, and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of such a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the angle and/or position of the shaft with respect to the club head body (and its ball striking face) can be readily changed and/or so that the club heads and shafts can be readily interchanged. Golf club head/shaft connection assemblies in accordance with at least some examples of this invention may include: (a) a first cylindrical structure having a first end and a second end opposite the first end, wherein the first end includes a first opening that defines a cylindrical interior chamber for receiving a golf club shaft, wherein an exterior surface of the cylindrical structure nearer to the first end than the second end includes a first rotation-inhibiting structure, and wherein the second end includes a securing structure; (b) a second cylindrical structure having a first end and a second end opposite the first end, wherein the first end defines an opening to a borehole for receiving the first cylindrical structure, wherein an interior surface of the second cylindrical structure nearer to the first end than the second end includes a second rotation-inhibiting structure; and (c) a securing system for releasably engaging the securing structure.

Further aspects of this invention relate to golf clubs in which the shaft is engaged with the golf club head using a shaft/club head connection assembly of the type described above. Such golf clubs may include: (a) a golf club head having a hosel area that provides access to a club head chamber defined in the club head, wherein the club head chamber extends completely through the club head and includes a first opening for receiving a securing member; (b) a club head connection member extending into the club head chamber of the golf club head, having a first end and a second end opposite the first end, wherein the first end defines an opening to a borehole, and wherein an interior surface of the club head connection member nearer to the first end than the second end includes a first rotation-inhibiting structure; (c) a shaft connection member extending into the borehole of the club head connection member, the shaft connection member including a cylindrical structure having a first end and a second end opposite the first end, wherein the first end of the shaft connection member includes a second opening that defines a cylindrical interior chamber for receiving a golf club shaft, wherein an exterior surface of the cylindrical structure nearer to its first end than its second end includes a second rotation-inhibiting structure that engages the first rotation-inhibiting structure on the club head connection member, and wherein the second end includes a securing structure; (d) a shaft engaged in the cylindrical interior chamber of the shaft connection member; and (e) a securing member extending through the second end of the club head connection member and into the second end of the club head chamber of the golf club head and releasably engaging the securing structure of the shaft connection member to thereby releasably engage the shaft connection member with the club head connection member and the golf club head.

The shaft may be angled and/or the chamber for receiving the shaft in the shaft connection member or shaft adapter may be angled or otherwise offset with respect to the axial direction of the shaft connection member so as to allow adjustment of the angle or position of the shaft with respect to the club head (e.g., with respect to its ball striking face, such as the lie angle and/or face angle). Additionally, the borehole of the club head connection member or sleeve insert may be angled or otherwise offset with respect to the axial direction of the club head connection member so as to allow a second and independent adjustment of the angle or position of the shaft with respect to the club head (e.g., with respect to its ball striking face, such as the lie angle and/or face angle). Furthermore, the club head and shaft may be interchanged with respect to one another by releasing the securing system and interchanging the originally present parts (e.g., shafts, club heads, etc.) with different parts, e.g., having different characteristics.

BRIEF DESCRIPTION OF THE DRAWINGS

A more complete understanding of the present invention and certain advantages thereof may be acquired by referring to the following detailed description in consideration with the accompanying drawings, in which.

Figure 1A:
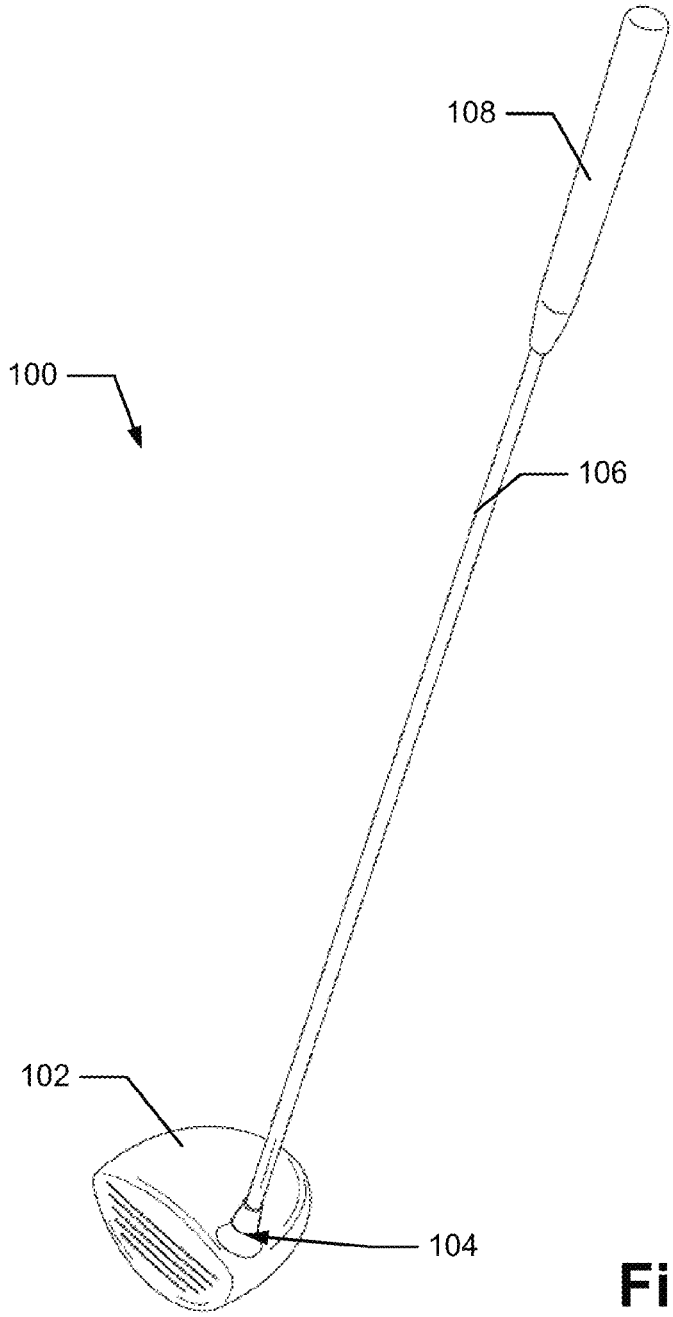
FIGS. 1A through 1C generally illustrate perspective views of an example golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Head/Shaft Connection Assemblies and Golf Clubs Including Such Assemblies According to Examples of the Invention In general, as described above, aspects of this invention relate to systems and methods for connecting golf club heads to shafts in a releasable manner so that the club heads and shafts can be readily interchanged and/or repositioned with respect to one another. More detailed descriptions of aspects of this invention follow.

1. Example Golf Club Head/Shaft Connection Assemblies and Golf Club Structures According to the Invention One aspect of this invention relates to golf club head/shaft connection assemblies for securely, but releasably, connecting a golf club head and shaft. Such assemblies may include, for example: (a) a shaft adapter being generally cylindrical in shape having a first end and an opposite second end, wherein the first end includes a first opening providing access to a cylindrical interior chamber for receiving a golf club shaft, wherein an exterior surface of the cylindrical structure (e.g., optionally nearer to the first end than the second end) includes a first rotation-inhibiting structure, and wherein the second end includes a securing structure; (b) a sleeve insert being generally cylindrical in shape, wherein a first end of the sleeve insert includes a second rotation-inhibiting structure that engages the first rotation-inhibiting structure and a second end of the sleeve insert includes a first opening for receiving a securing member; and (c) a securing system for releasably engaging the securing structure. While a variety of different securing structures and securing systems may be used without departing from this invention, in some example structures according to this invention, the securing structure will include a threaded hole defined in the second end of the shaft adapter, and the securing system will include a threaded bolt element that engages the threaded hole.

A variety of rotation-inhibiting structures and systems may be used without departing from this invention. In some example structures according to this invention, the rotation-inhibiting structure may include plural flat sides that extend in an axial direction of the shaft adapter and the interior cylindrical chamber (optionally to form a polygon cross section having from 3-25 sides). In some more specific examples, the polygon cross section of the shaft adapter structure that forms the rotation-inhibiting structure will have at least 4 flat sides (or even at least six or eight flat sides). Other non-round cross sectional configurations may be provided as part of the rotation-inhibiting structure without departing from this invention (e.g., splines, star or asterisk shaped exterior surfaces, oval or elliptical shaped exterior surfaces, non-regular or non-symmetrically shaped exterior surfaces, etc.).

The rotation-inhibiting structures may extend along any desired portion of an overall longitudinal (or axial) length of the shaft adapter without departing from this invention. In some more specific examples, the rotation-inhibiting structures will extend less than 50% of an overall axial length of the shaft adapter, or even less than 35% of the overall axial length. On the other hand, the rotation-inhibiting structures, when present on the exterior surface of the shaft adapter, will extend a sufficient portion of the overall longitudinal or axial length of the shaft adapter so as to provide a solid, non-rotational engagement and feel (e.g., at least 2% of the overall axial length). In some more specific examples, the rotation-inhibiting structures will extend from 2-65% of the overall axial length of the shaft adapter, or even from 5-50% or even 10-35% of the overall axial length. The rotation-inhibiting structures also may extend up to 100% of the overall axial length of the shaft adapter (e.g., from 50% to 100%, from 60% to 98%, or even from 70% to 96% of the overall axial length).

The exterior surface of the shaft adapter and its cylindrical interior chamber may be coaxial. On the other hand, these cylindrical structures need not be coaxial (e.g., they may extend in different directions, they may extend in parallel but in a non-coaxial direction, etc.). By providing non-coaxial cylindrical interior and exterior surfaces (or through other features of the club head, shaft, etc.), various properties, positions, angles, and the like of the shaft with respect to the club head ball striking face may be changed, as will be explained in more detail below. If desired, the exterior surface of the shaft adapter (e.g., at the first end thereof) may include a rotational position indicator to allow a user to easily see the position of the shaft/club head connection member with respect to the club head when in use.

Additionally, the exterior surface of the sleeve insert and its interior bore may be coaxial. On the other hand, these cylindrical structures need not be coaxial (e.g., they may extend in different directions, they may extend in parallel but in a non-coaxial direction, etc.). By providing non-coaxial interior bore and exterior surfaces (or through other features of the club head, shaft, etc.), various properties, positions, angles, and the like of the shaft with respect to the club head ball striking face may be changed, as will be explained in more detail below. If desired, the exterior surface of the sleeve insert (e.g., at the first end thereof) may include a rotational position indicator to allow a user to easily see the position of the shaft/club head connection member with respect to the club head when in use.

Aspects of this invention further relate to golf clubs in which the shaft is engaged with the golf club head using shaft/club head connection assemblies of the types described above. Such golf clubs may include: (a) a golf club head having a club head chamber that includes a first opening for receiving a securing member; (b) a shaft adapter being generally cylindrical in shape, the shaft adapter having a first end and an opposite second end, wherein the first end of the shaft adapter includes a second opening that defines a cylindrical interior chamber for receiving a golf club shaft, wherein an exterior surface of the shaft adapter includes a rotation-inhibiting structure, and wherein the second end includes a securing structure; (c) a sleeve insert extending into the club head chamber of the golf club head, the sleeve insert being generally cylindrical in shape, wherein a first end of the sleeve insert includes a second rotation-inhibiting structure that engages the first rotation-inhibiting structure and a second end of the sleeve insert includes a first opening for receiving a securing member; (d) a shaft engaged in the cylindrical interior chamber of the shaft adapter; (e) a securing member extending into the end of the club head chamber of the golf club head and releasably engaging the securing structure of the shaft adapter to thereby releasably engage the shaft connection member with the golf club head; and/or (f) a grip member engaged with the free end of the shaft. The securing member may be inserted into the club head chamber of the club head through an opening provided in the sole of the club head.

2. Example Methods of Producing and Using Golf Club Head/Shaft Connection Assemblies and Golf Clubs Including Such Assemblies According to the Invention Another aspect of this invention relates to methods of producing club head/shaft connection assemblies in accordance with examples of this invention (e.g., of the types described above). Such methods may include, for example: (a) producing a shaft adapter that is cylindrical in shape, the shaft adapter having a first end and an opposite second end (e.g., via casting or molding processes, via extrusion, etc.); (b) producing an open cylindrical interior chamber for receiving a golf club shaft at the first end of the shaft adapter (e.g., via drilling or machining processes, via casting or molding processes, etc.); (c) forming a rotation-inhibiting structure as part of an exterior surface of the shaft adapter, e.g., nearer to the first end than the second end (e.g., by grinding, machining, molding, casting, etc.); (d) forming a securing structure at the second end of the shaft adapter (e.g., by casting, molding, drilling, tapping, or machining processes, etc.); (e) producing a sleeve insert that is cylindrical in shape, the sleeve insert having a first end and an opposite second end (e.g., via casting or molding processes, via extrusion, etc.); (f) forming a second rotation-inhibiting structure as part of the first end of the sleeve insert that engages the first rotation-inhibiting structure (e.g., by grinding, machining, casting, molding, etc.); and (g) providing a securing member for engaging the securing structure (e.g., by manufacturing it, from third party suppliers, etc.). If desired, the securing structure may be formed as a threaded hole defined in the second end of the shaft adapter and the securing member may be provided as a threaded bolt element that is engagable with the threaded hole. The assembly may be formed so as to include any of the various structures and/or configurations described above (and described in more detail below).

Another aspect of this invention relates to methods of assembling golf clubs using club head/shaft connection assemblies in accordance with examples of this invention. Such methods may include: (a) providing a golf club head having a club head chamber (e.g., by manufacturing it, from a third party supplier, etc.), wherein the club head chamber includes a first opening for receiving a securing member; (b) engaging a shaft with a shaft adapter, wherein the shaft adapter is cylindrical in shape, the shaft adapter having a first end and an opposite second end (e.g., via cements or adhesives, via other fusing techniques, in a releasable manner, etc.); (c) placing a sleeve insert into the club head chamber of the golf club head, optionally in a non-rotational manner (e.g., by cements, adhesives, fusing techniques, mechanical connectors, using rotation-inhibiting structures, etc.), wherein the sleeve insert has a first end that includes a second rotation-inhibiting structure and a second end that includes a first opening; (d) placing at least a portion of the shaft adapter into the sleeve insert such that the first rotation-inhibiting structure engages the second rotation-inhibiting structure provided with the sleeve insert to thereby inhibit rotation of the shaft adapter with respect to the sleeve insert and the golf club head; (e) placing a securing member into the second end of the club head chamber; and (f) releasably engaging the securing member with a securing structure provided with the shaft adapter to thereby releasably engage the shaft adapter with the golf club head.

If desired, various characteristics or features of the club head may be changed, e.g., by changing a position of the shaft with respect to the club head (e.g., by rotating the shaft and its shaft adapter with respect to the club head when the cylindrical interior shaft receiving chamber of the shaft adapter is non-coaxial with respect to its exterior cylindrical surface) to thereby change the loft angle, lie angle, face angle, offset, inset, or other features of the club head. Such methods may include: (a) releasing or disengaging the shaft adapter with respect to the golf club head; (b) changing a position of the shaft adapter with respect to the golf club head (e.g., by rotating them with respect to one another) to thereby alter a position of a free end of the shaft with respect to a ball striking face of the club head; and (c) releasably engaging the securing member with the securing structure of the shaft adapter to thereby releasably engage the shaft adapter with respect to the golf club head at the changed position.

Additionally, or alternatively, aspects of the invention allow easy interchange of one sleeve insert for another sleeve insert. Such methods may include: (a) releasing or disengaging the shaft adapter with respect to a first sleeve insert and the golf club head; (b) releasing or disengaging the first sleeve insert with respect to the golf club head; (c) placing at least a portion of a second sleeve insert into the golf club head, wherein the second sleeve insert may have a different offset angle as compared to the first sleeve insert; (d) placing at least a portion of the shaft adapter into the second sleeve insert such that the rotation-inhibiting structure of the second sleeve insert engages the rotation-inhibiting structures provided on the shaft adapter to thereby inhibit rotation of the shaft adapter with respect to the second sleeve insert and the golf club head; (e) placing the securing member into the second end of the club head chamber; and (f) releasably engaging the securing member with a securing structure provided with the shaft adapter to thereby releasably engage the shaft adapter with the sleeve insert and the golf club head. In a similar manner to that described above, a given shaft (and shaft adapter) may be readily disengaged from a club head and engaged with a different club head in accordance with still additional aspects of this invention.

Instead of exchanging one sleeve insert for another sleeve insert, the position of the sleeve insert may be changed with respect to the club head, e.g., by rotating the sleeve insert with respect to the club head. Such methods may include: (a) releasing or disengaging the shaft adapter with respect to the sleeve insert and the golf club head; (b) at least partially releasing or disengaging a first sleeve insert with respect to the golf club head; (c) changing a rotational position or other orientation of the first sleeve insert with respect to the golf club head; (d) placing at least a portion of the shaft adapter into the first sleeve insert such that the rotation-inhibiting structure of the first sleeve insert engages the rotation-inhibiting structures provided on the shaft adapter to thereby inhibit rotation of the shaft adapter with respect to the first sleeve insert and the golf club head; (e) placing the securing member into the second end of the club head chamber; and (f) releasably engaging the securing member with a securing structure provided with the shaft adapter to thereby releasably engage the shaft adapter with the sleeve insert and the golf club head.

Specific examples of the invention are described in more detail below. The reader should understand that these specific examples are set forth merely to illustrate examples of the invention, and they should not be construed as limiting the invention.

C. Specific Examples of the Invention

Figure 1B:
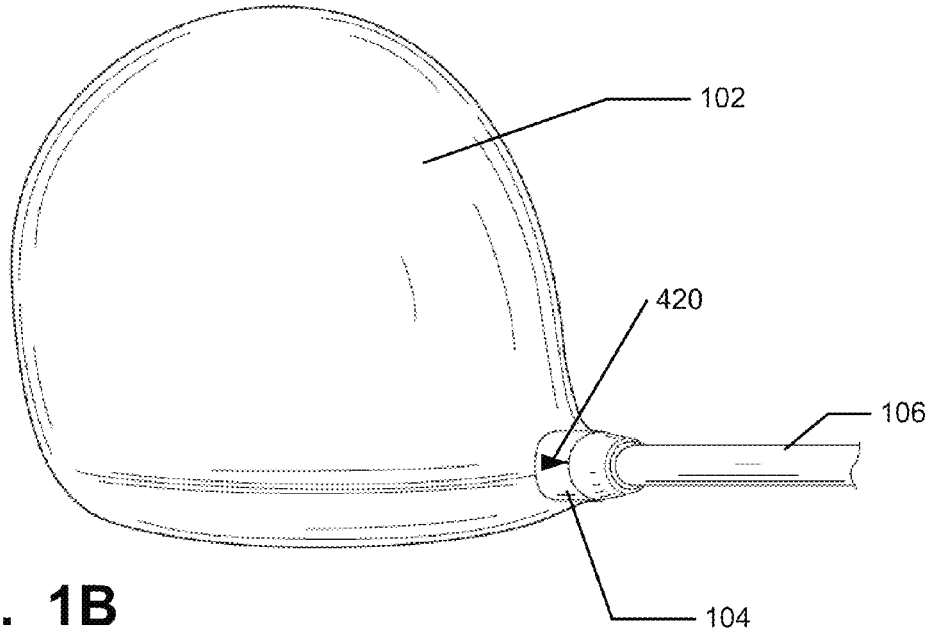
Figure 1C:
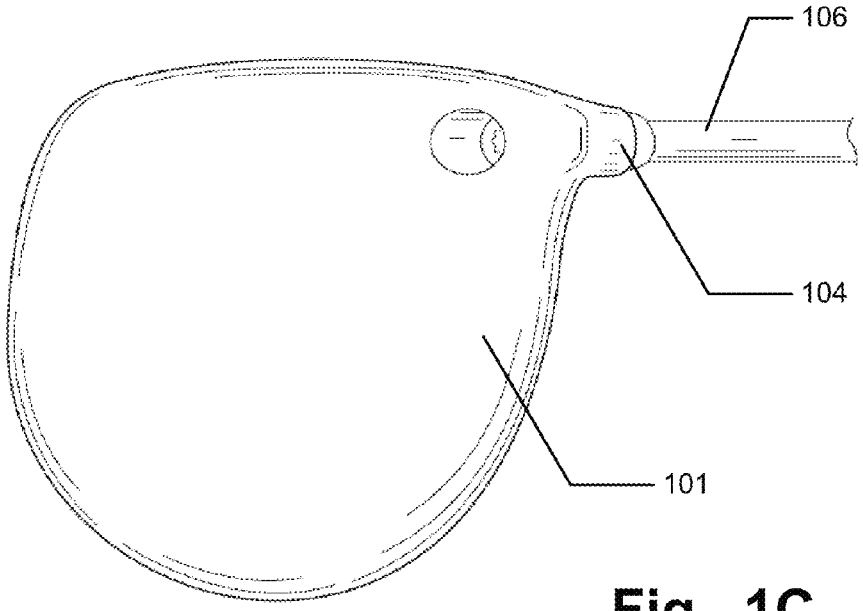

FIG. 1A generally illustrates an example golf club 100 in accordance with at least some examples of this invention. This club 100 includes a club head 102, a releasable club head/shaft connection region 104 that connects the club head to a shaft 106 (which will be described in more detail below), and a grip member 108 engaged with the shaft 106. While a driver/wood-type golf club head 102 is illustrated in FIGS. 1A, 1B, and 1C, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from any desired materials, in any desired construction and/or in any desired manner, including from conventional materials, in conventional constructions, in conventional manners, as are known and used in the art, optionally modified (if necessary, e.g., in size, shape, inclusion of structures, etc.) to accommodate the releasable club head/shaft connection parts, examples of which will be described in more detail below.

Any desired materials also may be used for the shaft member 106, including conventional materials that are known and used in the art, such as steel, graphite based materials, polymers, composite materials, combinations of these materials, etc. Optionally, if necessary or desired, the shaft 106 may be modified (e.g., in size, shape, etc.) to accommodate the releasable club head/shaft connection parts. The grip member 108 may be engaged with the shaft 106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 may be releasably connected to the shaft 106 using a releasable connection like releasable connection 104 (examples of which will be described in more detail below).

Figure 3A:
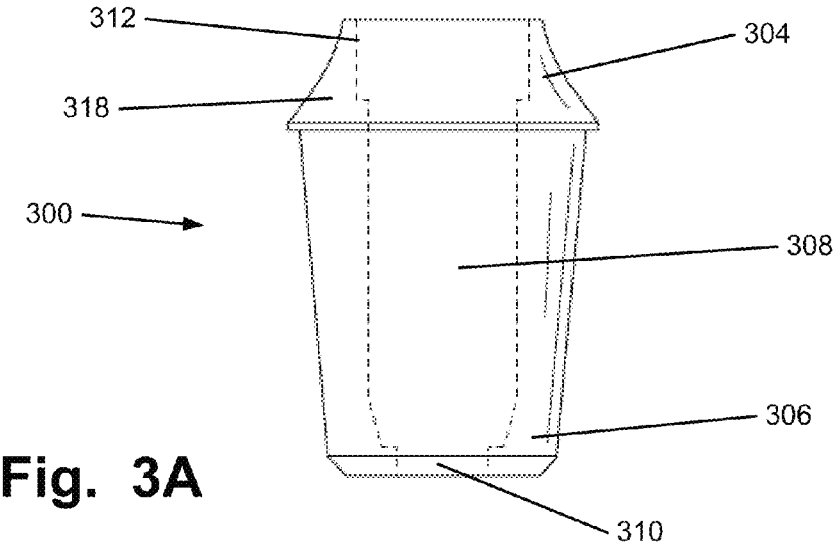
FIGS. 3A and 3B illustrate various views of an example club head connection member that may be used in accordance with examples of this invention.
Figure 3B:
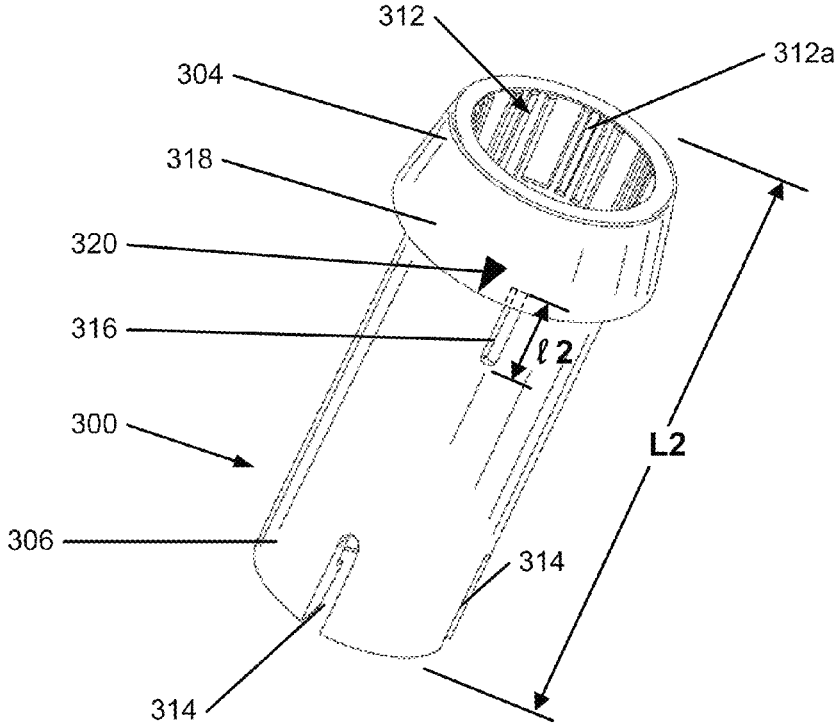
Figure 4A:
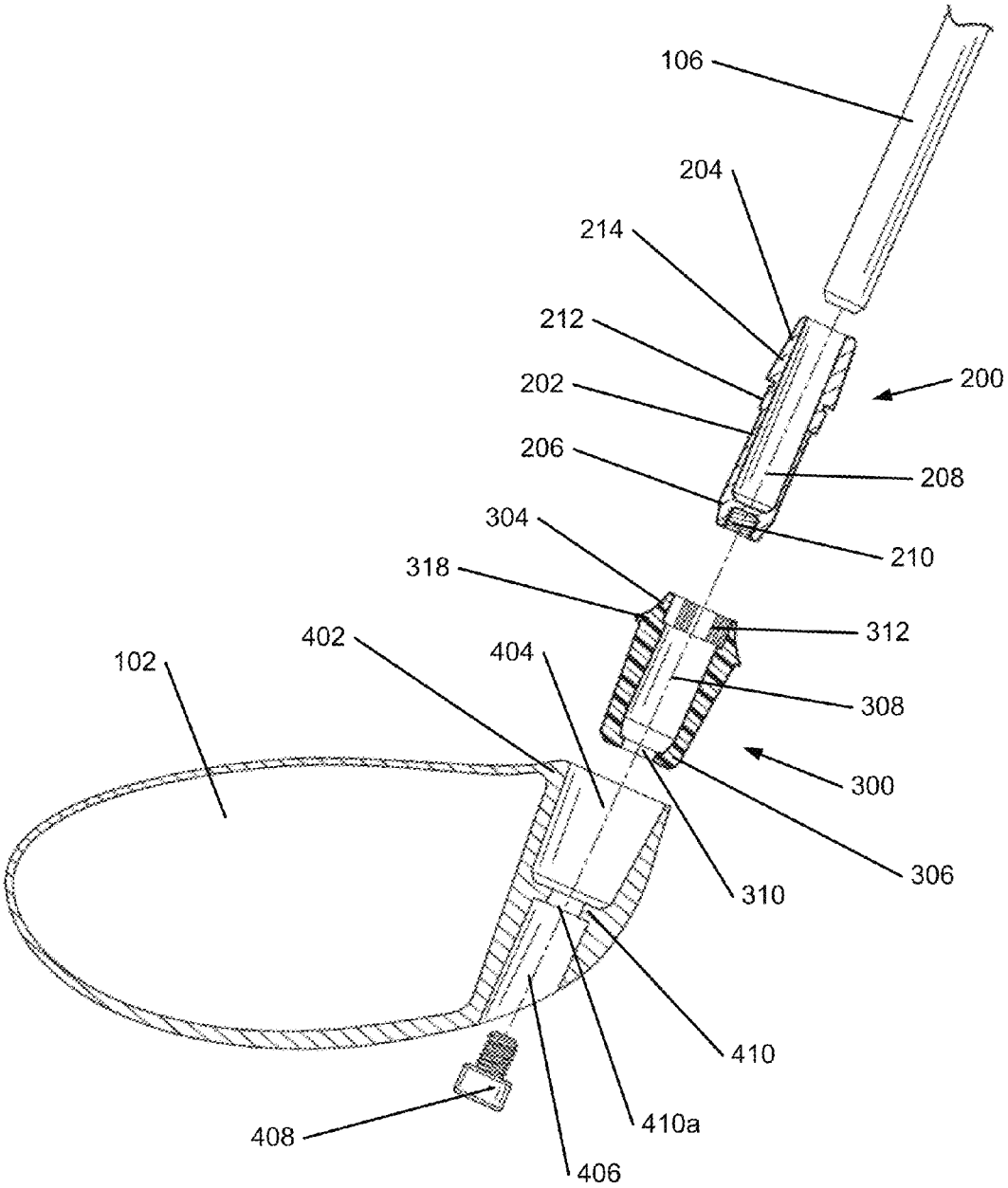
FIG. 4A illustrates an expanded cutaway view of a golf club utilizing an example golf club head/shaft connection system in accordance with an example of this invention.

A releasable connection 104 between golf club heads and shafts in accordance with examples of this invention now will be described in more detail in conjunction with FIGS. 2A through 4B. FIG. 4A illustrates an exploded view of the releasable connection 104. As illustrated in FIG. 4A, this releasable connection 104 between the golf club head 102 and the shaft 106 includes a shaft adapter 200 and a sleeve insert 300. Generally, the sleeve insert 300 is configured to engage in the golf club head 102, the shaft adapter 200 is configured to engage in the sleeve insert 300, and the shaft 106 is configured to engage the shaft adapter 200. The details of the engagement of these example components/parts will be explained in more detail below.

Figure 2A:
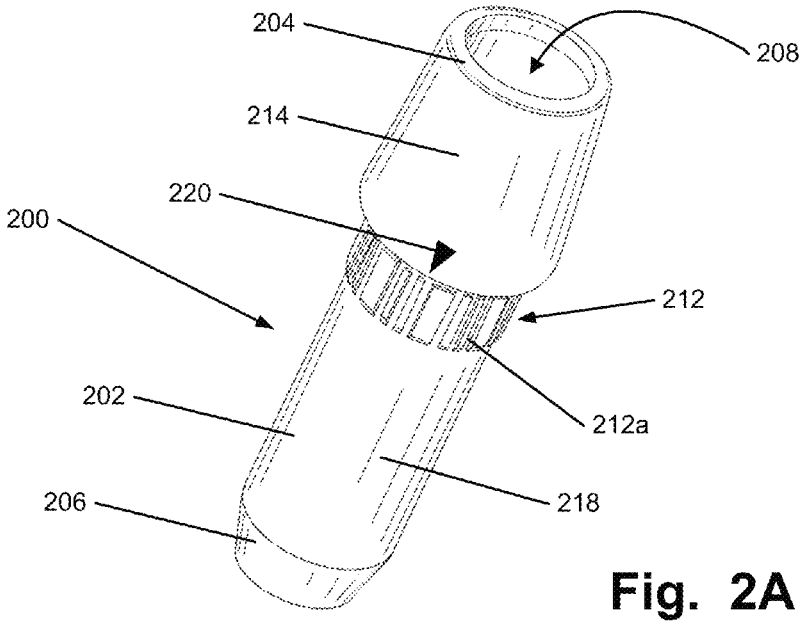
FIGS. 2A and 2B illustrate various views of an example shaft connection member that may be used in accordance with examples of this invention.
Figure 2B:
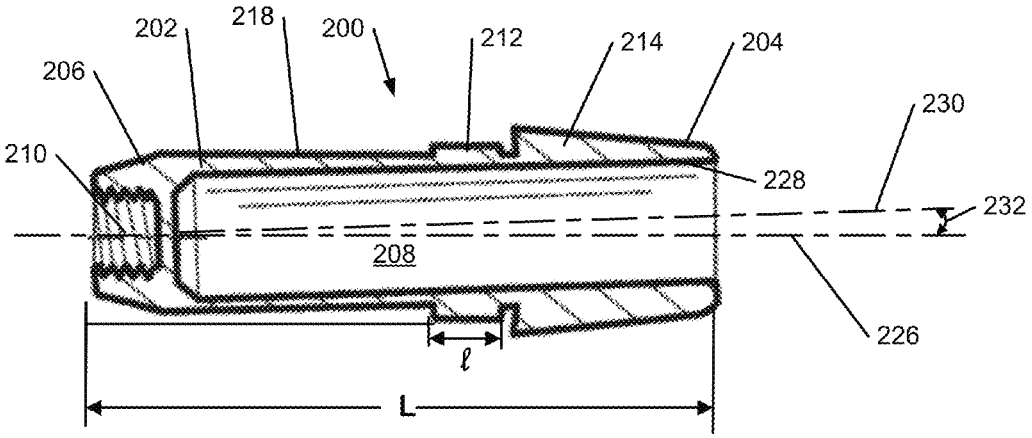

As noted above, the releasable connection 104 may include an example shaft adapter 200 in accordance with this invention. As illustrated in FIGS. 2A and 2B, this example shaft adapter 200 includes a generally cylindrical body 202 having a first end 204 and an opposite second end 206. The first end 204 defines an opening to an interior cylindrical chamber 208 for receiving the end of a golf club shaft 106. The second end 206 includes a securing structure (e.g., a threaded hole 210 in this example structure) that assists in securely engaging the shaft adapter 200 to a club head body 102 as will be explained in more detail below. In this example structure, as shown in FIG. 2B, the interior chamber 208 is not open to the threaded hole 210 (i.e., it is a blind hole), but if desired, the threaded hole 210 may extend to and open in to the interior chamber 208 in some structures in accordance with this invention.

As shown, at least a portion of the first end 204 of the shaft adapter 200 includes a first rotation-inhibiting structure 212. While a variety of rotation-inhibiting structures may be provided without departing from this invention, in this example structure, the rotation-inhibiting structure 212 constitutes splines 212*a* extending along the longitudinal axis 226 of the exterior surface of the shaft adapter 200. The splines 212*a* of the shaft adapter 200 may prevent rotation of the shaft adapter 200 with respect to the member into which it is fit (e.g., a sleeve insert and/or the golf club head, as will be explained in more detail below). While a variety of non-rounded cross sectional structures may be used without departing from the invention, in the illustrated example, a portion of the first end 204 of the cylindrical body 202 has a set of splines 212*a* with a pattern that repeats eight times around the exterior circumference of the shaft adapter 200.

The first rotation-inhibiting structure 212 may extend along any desired portion of the overall longitudinal length L of the shaft adapter 200. For example, the length l of the first rotation-inhibiting structure 212 may be less than 65% of the overall length L of the shaft adapter 200, and in some examples, it may be less than 50%, less than 35%, or even less than 25% of the overall axial length L. On the other hand, the first rotation-inhibiting structure 212 may extend along any desired portion of the overall longitudinal length L of the shaft adapter 200. For example, the rotation-inhibiting structure 212 should be of sufficient length l to enable strong and secure engagement with the sleeve insert 300 and the club head 102 in a non-rotational manner. As some more specific examples, the length l may be at least 2% of the overall length L of the shaft adapter 200, and in some examples at least 5%, at least 10%, or even least 20% of the overall axial length L. If desired, the rotation-inhibiting structure 212 may extend from 2-65% of the overall axial length L of the shaft adapter 200, or even from 5-50% or 10-35% of the overall length L. If desired, the rotation-inhibiting structure 212 may extend all or substantially all of the overall longitudinal length L.

FIGS. 2A and 2B further illustrate that the first end 204 of the shaft adapter 200 includes an expanded portion 214. As will be more apparent from FIGS. 4A and 4B, this expanded portion 214 provides a stop that prevents the shaft adapter 200 from extending into the sleeve insert 300 and the club head body and provides a strong base for securing the shaft adapter 200 to the sleeve insert 300 and the club head body 102. Also, the exterior shape of the first end 204 may be tapered to provide a smooth transition between the shaft 106, the sleeve insert 300, and the club head 102 and a conventional aesthetic appearance.

Other features of this example shaft adapter 200 are illustrated in FIG. 2B. For example, the shaft adapter 200 may include an "off-axis" or angled bore hole or interior chamber 208 in which the shaft 106 is received. More specifically, in this illustrated example, the outer cylindrical surface 218 of the shaft adapter 200 extends in a first axial direction 226, and the interior cylindrical surface 228 of the bore hole 208 extends in a second axial direction 230 that differs from the first axial direction 226, thereby creating a shaft adapter offset angle 232. In this manner, while the shaft adapter 200 exterior maintains a constant axial direction corresponding to that of the interior of the club head hosel and/or sleeve insert 300 and their openings, the shaft 106 extends away from the club head 102 and the sleeve insert 300 at a different and adjustable angle with respect to the club head 102, the sleeve insert 300, and the club head's ball striking face. The shaft position and/or angle may be adjusted, for example, by rotating the shaft adapter 200 with respect to the sleeve insert 300 and the club head hosel.

While any desired shaft adapter offset angle 232 may be maintained between the first axial direction 226 and the second axial direction 230, in accordance with some examples of this invention, this shaft adapter offset angle 232 may be between 0.25 degrees and 10 degrees, and in some examples between 0.5 degrees and 8 degrees, between 0.75 degrees and 6 degrees, or even between 1 degree and 4 degrees. In more specific examples of the invention, the shaft adapter offset angle 232 may by approximately 1.5 degrees offset or 2.0 degrees offset.

The shaft adapter 200 may be made from any desired materials and from any desired number of independent parts without departing from this invention. In this illustrated example, the entire shaft adapter 200 is made as a unitary, one-piece construction from conventional materials, such as metals or metal alloys, plastics, and the like. In at least some example structures according to this invention, the shaft adapter 200 will be made from a titanium, aluminum, magnesium, steel, or other metal or metal alloy material. The various holes (e.g., chamber 208 and threaded opening 210) and/or surface structures (e.g., splines 212*a*, expanded portions) may be produced in the material in any desired manner without departing from the invention, including via production methods that are commonly known and used in the art, such as by drilling, tapping, machining, lathing, extruding, grinding, casting, extruding, molding, etc.

The example releasable connection 104 may further include a sleeve insert 300. FIGS. 3A and 3B illustrate an example sleeve insert 300 in accordance with this invention. As shown, the sleeve insert 300 is generally cylindrical in shape. The sleeve insert 300 may also be other shapes without departing from this invention. For example, the sleeve insert 300 may be in the shape of an oval, rectangle, square, triangle, or other polygon shapes. The sleeve insert 300 has a first end 304 and an opposite second end 306. The first end 304 defines an opening to a borehole 308 for receiving the shaft adapter 200. Within the first end 304 and along the interior sides of the borehole 308, the first end 304 includes a second rotation-inhibiting structure 312 configured to engage the first rotation-inhibiting structure 212 on the shaft adapter 200 (e.g., in an interlocking manner with respect to rotation). The second end 306 of the sleeve insert 300 defines a second opening 310 for receiving a securing member 408. Generally, the second opening 310 is sized such that the securing member 408 is able to freely pass through the second opening 310 to engage the threaded hole 210 in the shaft adapter 300. Alternatively, if desired, the securing member 408 also may engage the sleeve insert 300 at the second opening 310 (e.g., the second opening 310 may include threads that engage threads provided on the securing member 408).

As illustrated in FIG. 3B, the second end 306 of the sleeve insert 300 may define one or more notches or grooves 314. The grooves 314 may allow the second end 306 of the sleeve insert 300 to flare inward towards the center of the bore 308. For example, when the sleeve insert 300 is inserted into the club head 102 and club head chamber 404, the grooves 314 help to take up any tolerance within the sleeve insert bore 308 when the second end 306 of the sleeve insert 300 contacts the bottom portion of the club head chamber 404. The grooves 314 may cooperate with the club head 102 (e.g., flaring within the bore 308 and taking up tolerance within the club head chamber 404) to cause the sleeve insert 300 to be stable within the club head 102. The notches or grooves 314 may extend axially along the exterior of the sleeve insert 300 along any desired portion of the overall longitudinal length L2 of the sleeve insert 300. Generally, the grooves 314 are dimensioned for optimum fit and stability for the sleeve insert 300 within the club head 102.

The sleeve insert 300 may also be non-rotatable with respect to the golf club head 102. As illustrated in FIG. 3B, the sleeve insert 300 may also define a key or tab 316. The key or tab 316 may cooperate with the club head 102 (e.g. engage structures provided in the club head 102, such as a slot or groove within the club head chamber 404) to cause the sleeve insert 300 to be stable and non-rotatable within the club head 102. The key or tab 316 may extend axially along the exterior of the sleeve insert 300 just below the expanded portion 318, extending from the expanding portion 318 towards the second end 306 of the sleeve insert 300. For example, the length l 2 of the key or tab 316 may be less than 75% of the overall length L2 of the sleeve insert 300, and in some examples, the length l 2 of the key or tab 316 may be less than 50%, or even less than 25% of the overall axial length L2. On the other hand, the key or tab 316 may extend along any desired portion of the overall longitudinal length L2 of the sleeve insert 300. For example, the key or tab 316 should be of sufficient length l 2 to enable strong and secure engagement of the sleeve insert 300 with the club head 102 in a non-rotational manner. As some more specific examples, the length l 2 may be at least 2% of the overall length L2 of the sleeve insert 300, and in some examples at least 5%, at least 10%, or even least 20% of the overall axial length L2. If desired, the key or tab 316 of the sleeve insert 300 may extend from 2-75% of the overall axial length L2 of the sleeve insert 300, or even from 5-50%, or 10-35% or 20-75% of the overall length L2. Without departing from this invention, the sleeve insert 300 may include multiple keys or tabs 316 to engage and cooperate with similar structures within the club head 102, thereby allowing the sleeve insert 300 to rotate within the club head 102 into different indexing positions for the sleeve insert 300.

The sleeve insert 300 may be permanently engaged in the club head 102, if desired, without departing from this invention. For example, the sleeve insert 300 may be engaged with the club head 102 with via an adhesive or cement bond. In this instance, the sleeve insert 300 may or may not include a notch and/or a key as described above. The permanent-engagement of the sleeve insert 300 with the club head 102 provides the non-rotatable functionality as described above.

As illustrated in FIGS. 3A and 3B, at least a portion of the interior of the first end 304 of the sleeve insert 300 includes a first rotation-inhibiting structure 312. While a variety of rotation-inhibiting structures may be provided without departing from this invention, in this example structure, the rotation-inhibiting structure 312 constitutes splines 312*a* extending along the interior longitudinal axis. The splines 312*a* of the sleeve insert 300 may prevent rotation of the shaft adapter 200 with respect to the sleeve insert 300 into which it is fit (and ultimately with respect to a golf club head). While a variety of non-rounded cross sectional structures may be used without departing from the invention, in the illustrated example, a portion of the first end 304 of the sleeve insert 300 has a set of splines 312*a* with eight repeating patterns to thereby provide eight different rotational positions of the shaft adapter 200 with respect to the sleeve insert 300, in this illustrated example. In other example structures, the sleeve insert 300 may have a set of splines 312*a* with appropriate structures to provide four, sixteen, or thirty-two different rotational positions with respect to the shaft adapter 200.

FIGS. 3A and 3B further illustrate that the first end 304 of the sleeve insert 300 includes an expanded portion 318. As will be more apparent from FIGS. 4A and 4B, this expanded portion 318 provides a stop that prevents the sleeve insert 300 from extending into the club head body and provides a strong base for securing the sleeve insert 300 to the club head body 102. Also, the exterior shape of the first end 304 may be tapered to provide a smooth transition between the shaft 106 and the club head 102 and a conventional aesthetic appearance.

The sleeve insert 300 may be made from any desired materials and from any desired number of independent parts without departing from this invention. In this illustrated example, the entire sleeve insert 300 is made as a unitary, one-piece construction from conventional materials, such as metals or metal alloys, plastics, and the like. In at least some example structures according to this invention, the sleeve insert 300 will be made from a titanium, aluminum, magnesium, steel, or other metal or metal alloy material. The bore and/or surface structures (e.g., splines 312*a*, expanded portions) may be produced in the material in any desired manner without departing from the invention, including via production methods that are commonly known and used in the art, such as by drilling, tapping, machining, lathing, extruding, grinding, casting, molding, etc.

The adjustment of the rotational position of the shaft adapter 200 (and its attached shaft 106) will be explained in more detail below in conjunction with FIGS. 4A through 4C. Changing the rotational position of the shaft adapter 200 with respect to the sleeve insert 300 may adjust one or more of various features of the overall golf club, such as loft angle, lie angle, face angle, inset distance, offset distance, to fade bias, to draw bias, etc. To enable users to easily identify the club head's "settings" (e.g., the club head body 102 position and/or orientation with respect to the shaft 106), any or all of the shaft 106, the shaft adapter 200, sleeve insert 300, and/or the club head 102 may include markings or indicators. FIG. 2A shows an indicator 220 on the shaft adapter 200 (e.g., on the expanded portion 214). FIG. 3B shows an indicator 320 on the sleeve insert 300 (e.g., on the expanded portion 318). FIG. 1B shows an indicator 420 on the hosel area of the club head 102. By noting the relative positions of the various indicators, a club fitter or other user can readily determine and know the position of the shaft 106 with respect to the club head body 102 and its ball striking face. If desired, the indicators (e.g., indicators 220, 320, or 420) may be associated with and/or include specific quantitative information, such as a specifically identified loft angle, lie angle, face angle, inset distance, offset distance, etc.

One example of engagement of a golf club shaft 106 with a club head 102 utilizing the shaft adapter 200 and the sleeve insert 300 will be described in more detail in conjunction with FIGS. 4A and 4B. At some time during the head/shaft connection process, a shaft 106 is engaged within the cylindrical interior chamber 208 of the shaft adapter 200. In this illustrated example structure, the shaft 106 will be permanently engaged in the chamber 208, e.g., via an adhesive or cement bond. Other ways of engaging a shaft 106 with the shaft adapter 200 are possible without departing from this invention, including, for example, mechanical connections (including releasable mechanical connections, such as threaded structures or the like); welding, brazing, soldering, or other fusing techniques; etc. Once connected to the shaft adapter 200, the shaft 106 is ready for engaging a sleeve insert 300 and mounting to a golf club head 102. Alternatively, if desired, the shaft 106 may be connected to the shaft adapter 200 later in the process, even as late as the final step in the connection process.

Figure 4B:
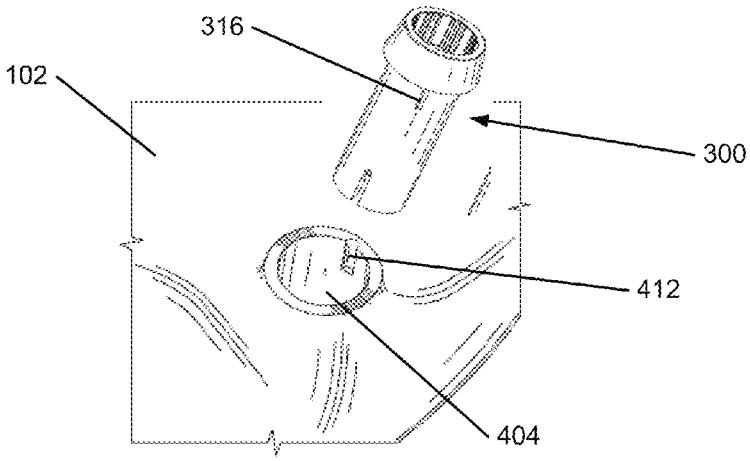
FIG. 4B illustrates an exploded view of a golf club head and club head connection member that may be used in accordance with examples of this invention.
Figure 4C:
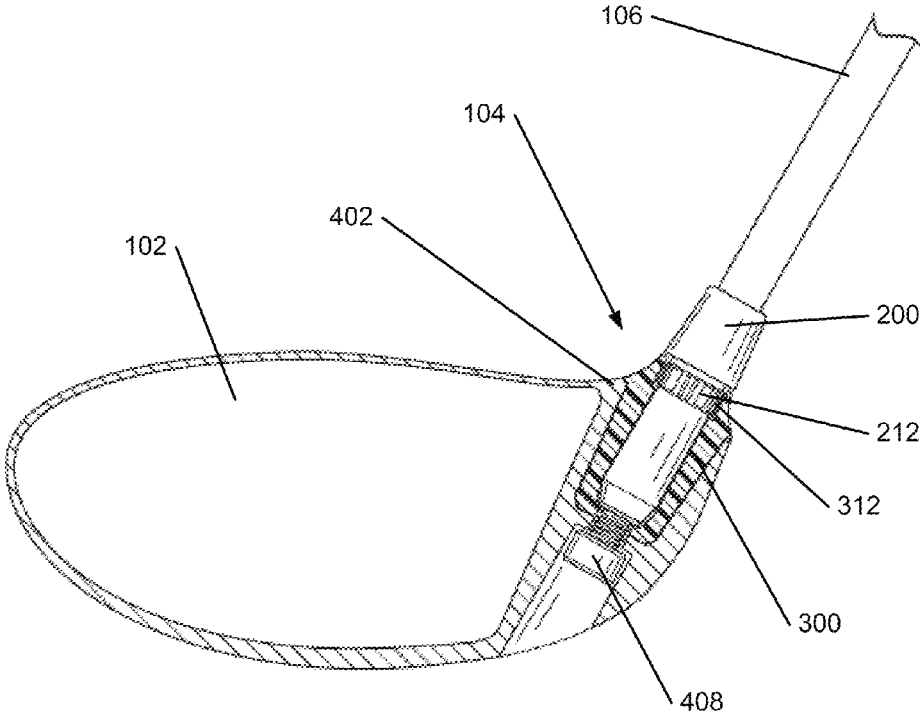
FIG. 4C illustrates a cutaway view of a golf club utilizing an example golf club head/shaft connection system in accordance with an example of this invention.
Figure 5A:
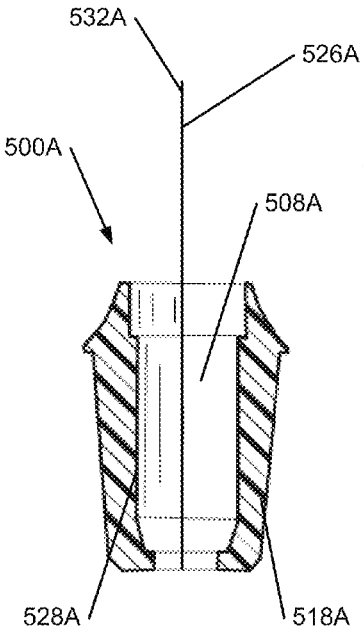
FIGS. 5A through 5F illustrate various views of certain features of other example golf club/shaft connection members that may be used with the golf club illustrated in FIGS. 4A and 4B in accordance with an example of this invention.
Figure 5B:
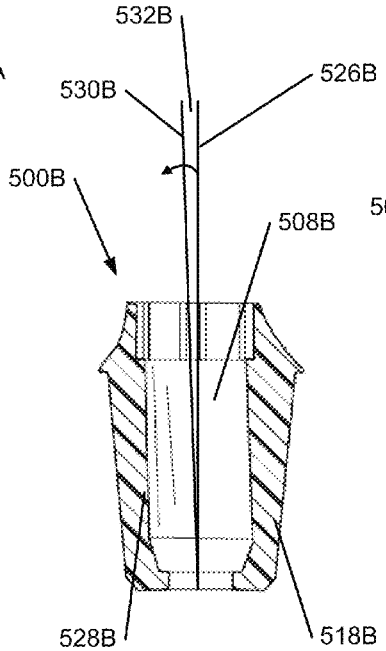
Figure 5C:
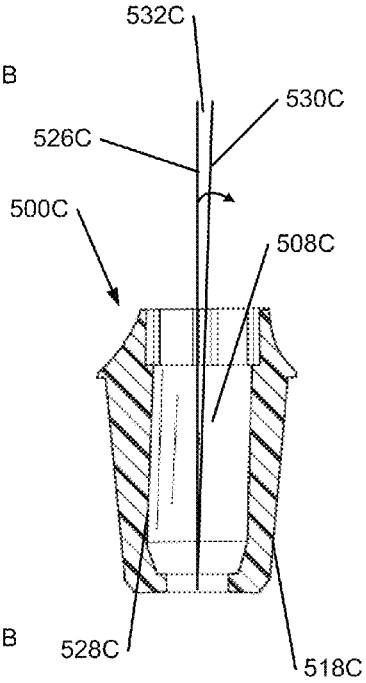
Figure 5D:
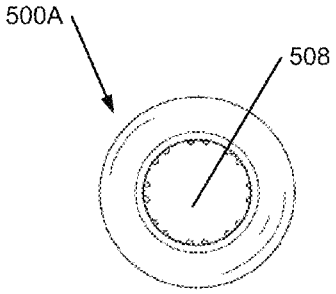
Figure 5E:
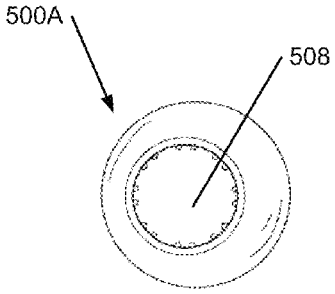
Figure 5F:
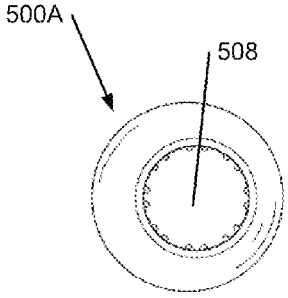

An example club head structure 102 now will be described in more detail, particularly in conjunction with FIGS. 4A through 4C (FIG. 4A provides an exploded sectional view, 4B provides a close-up view of the club head 102 and hosel assembly with the sleeve insert 300, while FIG. 4C provides an assembled sectional view of the releasable club head/shaft connection). In this example structure, the club head 102 includes a hosel area 402 that provides access to a club head chamber 404 defined in the club head 102. The club head chamber 404 in this example structure extends completely through the club head body 102 and produces an opening 406 at the sole or bottom of the club head 102. This opening 406 allows access for insertion of a securing system 408 (e.g., a threaded bolt member) that helps secure the shaft adapter 200 and sleeve insert 300 to the club head body 102, as will be described in more detail below. In this example structure, the club head chamber 404 includes a mounting plate 410 with a hole 410*a* defined therein, which provides a support surface for securing the shaft adapter 200 and sleeve insert 300 within the club head body 102, as will be explained in more detail below. If desired, the mounting plate 410 may be integrally formed as part of the club head structure, and it may be located at any desired position along the club head chamber 404, including right at or near the opening 406. Additionally or alternatively, if desired, a plug member may be provided close to opening 406 (optionally a removable plug member) or the sole member may include a countersunk region to allow the bolt member 408 to lie flush or substantially flush with the club head sole.

The club head chamber 404 in this example structure may include a groove or slot 412, as illustrated in FIG. 4B. The groove or slot 412 may extend axially along the interior surface of the club head chamber 404. For example, the groove or slot 412 should be of sufficient length to enable strong and secure engagement with the key or tab 316 of the sleeve insert 300 inside the club head 102 in a non-rotational manner. The groove or slot 412 on the club head chamber 404 should generally correspond to the size, shape, and location of the key or tab 316 of the sleeve insert 300.

Connection of the shaft adapter 200 (optionally with a shaft 106 already engaged with it) to the club head 102 will be described in more detail in conjunction with FIGS. 4A and 4B. As shown, the sleeve insert 300 may be inserted into the club head chamber 404 of the club head body 102 in an appropriate manner, such that at least one key or tab 316 of the sleeve insert 300 aligns with and engages the at least one slot or groove 412 of the club head chamber 404. Additionally, the cylindrical body 202 of the shaft adapter 200 may be inserted into the first end 304 and the borehole 308 of the sleeve insert 300 in an appropriate manner such that the rotation-inhibiting structures 212 of the shaft adapter 200 engage the rotation-inhibiting structures 312 of the sleeve insert 300. As the sleeve insert 300 is inserted into the club head chamber 404 of the club head body 102, the second end 306 of the sleeve insert 300 flares against the sides of the club head chamber 404 to take up any tolerances between the sleeve insert 300 and the club head chamber 404. At this location and in this arrangement, the second end 206 of the shaft adapter 200 and the second end 306 of the sleeve insert 300 are seated against the mounting plate 410. Additionally, the expanded portion 318 of the sleeve insert 300 is located adjacent to and/or seated against the top surface of the hosel 402. Further, the expanded portion 214 of the shaft adapter 200 first end 204 is seated against the top surface of the first end 304 of the sleeve insert 300.

Once inserted, the shaft adapter 200 and sleeve insert 300 may be engaged and secured with the club head body 102 by inserting the securing member or bolt member 408 through the opening 406 in the sole of the club head 102, through the opening 310 of the sleeve insert 300, and engaging the securing member 408 with the securing structure 210 provided with the shaft adapter 200. If desired, the locations where the sleeve insert 300 meets the club head 102 (e.g., at mounting plate 410 and/or the hosel opening) and/or where the securing member 408 meets the club head 102 (e.g., at the mounting plate 410) may include a flexible material (such as a washer, a gasket, an o-ring, an elastomeric washer or coating, etc.) to take up any extra space and to provide noise and/or vibration dampening, etc. This illustrated connection system is readily releasable, e.g., by twisting out the bolt member 408, to allow users to interchange different shafts 106 on a given golf club head 102 and/or to allow users to interchange different golf club heads 102 on a given shaft/connection member assembly. Additionally, the releasable connection system allows users to interchange different shaft adapters 200 and/or different sleeve inserts 300 for a given golf club head 102 and/or to change the relative positioning of the shaft adapter 200 and/or sleeve insert 300 with respect to the golf club head 102.

If desired, the bolt 408 and mounting plate opening 410*a* may be structured so as to prevent the bolt 408 from completely falling out of the opening 406 when the bolt 408 is released from the shaft adapter 200 and sleeve insert 300 (e.g., by providing an enlarged ring on the free end of bolt 408). The bolt 408 may include a head having structures for engaging a screwdriver, an allen wrench, or another tool.

Various releasable golf club head/shaft connections are known in the art and are commercially available. Most such connection systems, however, provide a single angle adjustment and do not have the capability to provide an independent axis adjustment to one of the lie angle and/or the face angle. For example, with a single angle adjustment, when the shaft is rotated with respect to the club head, the lie angle and the face angle may both possibly be adjusted. As will be described below, at least some example structures according to the present invention provide a second and independent axis of adjustment to provide the capability to have independent control over adjusting one of the lie angle and/or the face angle. The second independent axis of adjustment can be provided by adjusting the sleeve insert and/or by the use of different sleeve inserts. As one more specific example, the releasable connection system shown in FIGS. 4A and 4B may be utilized with different sleeve inserts.

As further illustrated in FIGS. 5A through 5F, in one example of this aspect of the invention, the releasable connection system may include three different sleeve inserts 500A, 500B, 500C. Each of the sleeve inserts 500A, 500B, 500C may provide a unique angle of adjustment. Specifically, some sleeve inserts include an "off-axis" or angled bore 508 in which the shaft adapter 200 is received. More specifically, in this illustrated example, the outer cylindrical surfaces 518 of the sleeve inserts 500B and 500C extend in a first axial direction 526, and the interior cylindrical surfaces 528 of the bores 508 extend in a second axial direction 530 that differs from the first axial direction 526, thereby creating a sleeve insert offset angle 532 (sleeve insert 500A is a "neutral" sleeve insert in which the exterior surface 518A is co-axial with the interior surface 528A). In this manner, while the sleeve insert 500B and 500C exterior maintain a constant axial direction corresponding to that of the interior of the club head hosel and its opening, the shaft adapter 200 extends away from the club head 102 and the sleeve inserts 500B and 500C at a different and adjustable angle with respect to the club head 102, the sleeve insert, and the club head's ball striking face.

For the example illustrated in FIGS. 5A through 5F, the releasable connection system may include three different sleeve inserts. A first sleeve insert may be a neutral sleeve insert 500A that has a zero offset angle 532A. A second sleeve insert may be an upright sleeve insert 500B that has a negative offset angle 532B. The upright sleeve insert 500B has an off-axis or angled bore 508B that causes the club head 102 to be at an upright lie or the lie angle 532B to be positive. For example, an upright lie angle or positive lie angle 532B may be maintained between the first axial direction 526B and the second axial direction 530B. A third sleeve insert may be a flat sleeve insert 500C that has a positive offset angle 532C. The flat sleeve insert 500C has an off-axis or angled bore 508C that causes the club head 102 to be at a flat lie or the lie angle 532C to be negative. For example, a flat lie angle or negative lie angle 532C may be maintained between the first axial direction 526C and the second axial direction 530C. While any desired sleeve insert offset angle 532 may be maintained between the first axial direction 526 and the second axial direction 530, in accordance with some examples of this invention, this sleeve insert offset angle 532 may be between 0.25 degrees and 10 degrees, and in some examples between 0.5 degrees and 8 degrees, between 0.75 degrees and 6 degrees, or even between 1 degree and 4 degrees. In more specific examples of the invention, the sleeve insert offset angle 532 may by approximately 1.5 degrees offset or 2.0 degrees offset.

Figure 6:
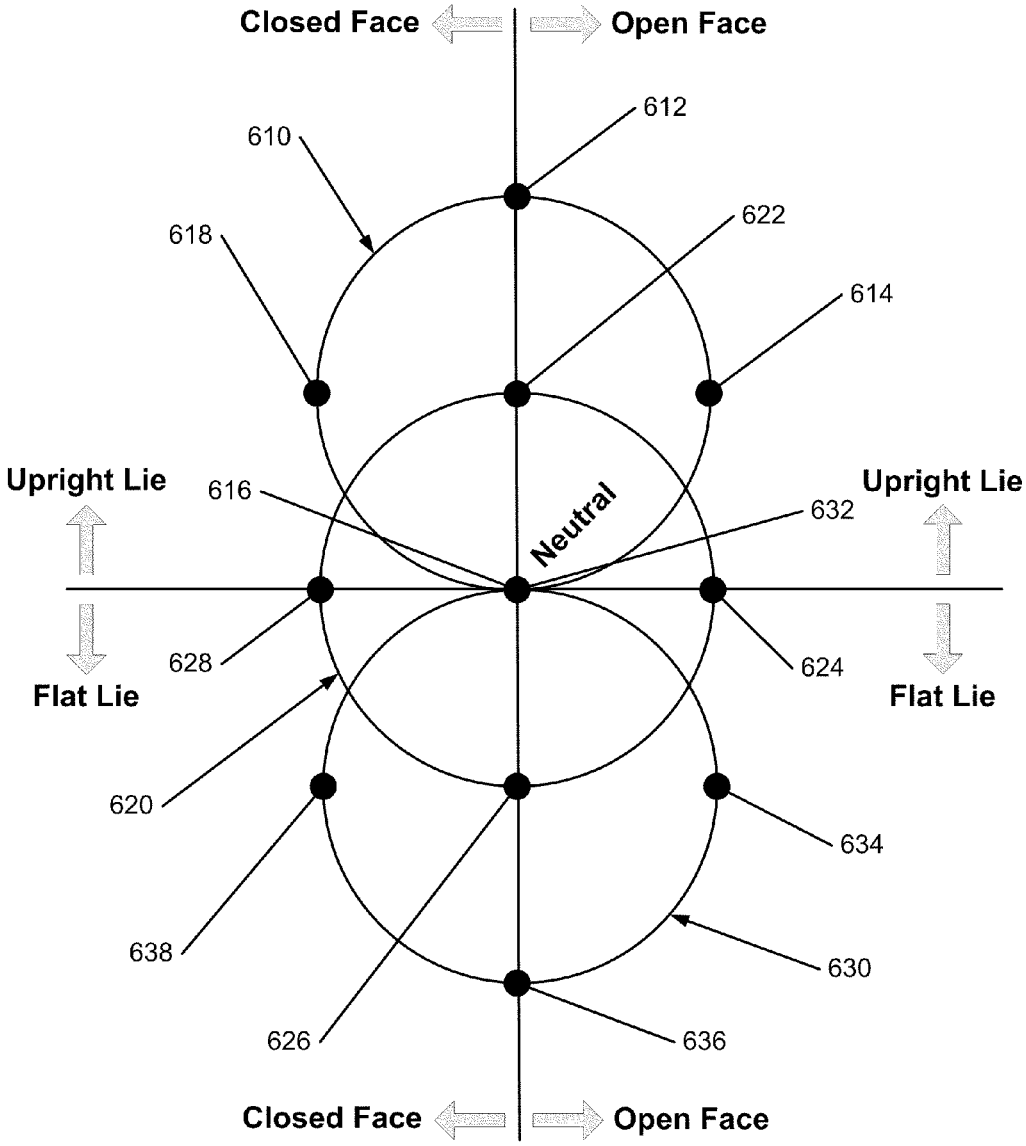
FIGS. 6 through 9 illustrate schematics that represent potential adjustment positions for a golf club when using example releasable connection systems like those illustrated in FIGS. 4A through 5F in accordance with examples of this invention.
Figure 7:
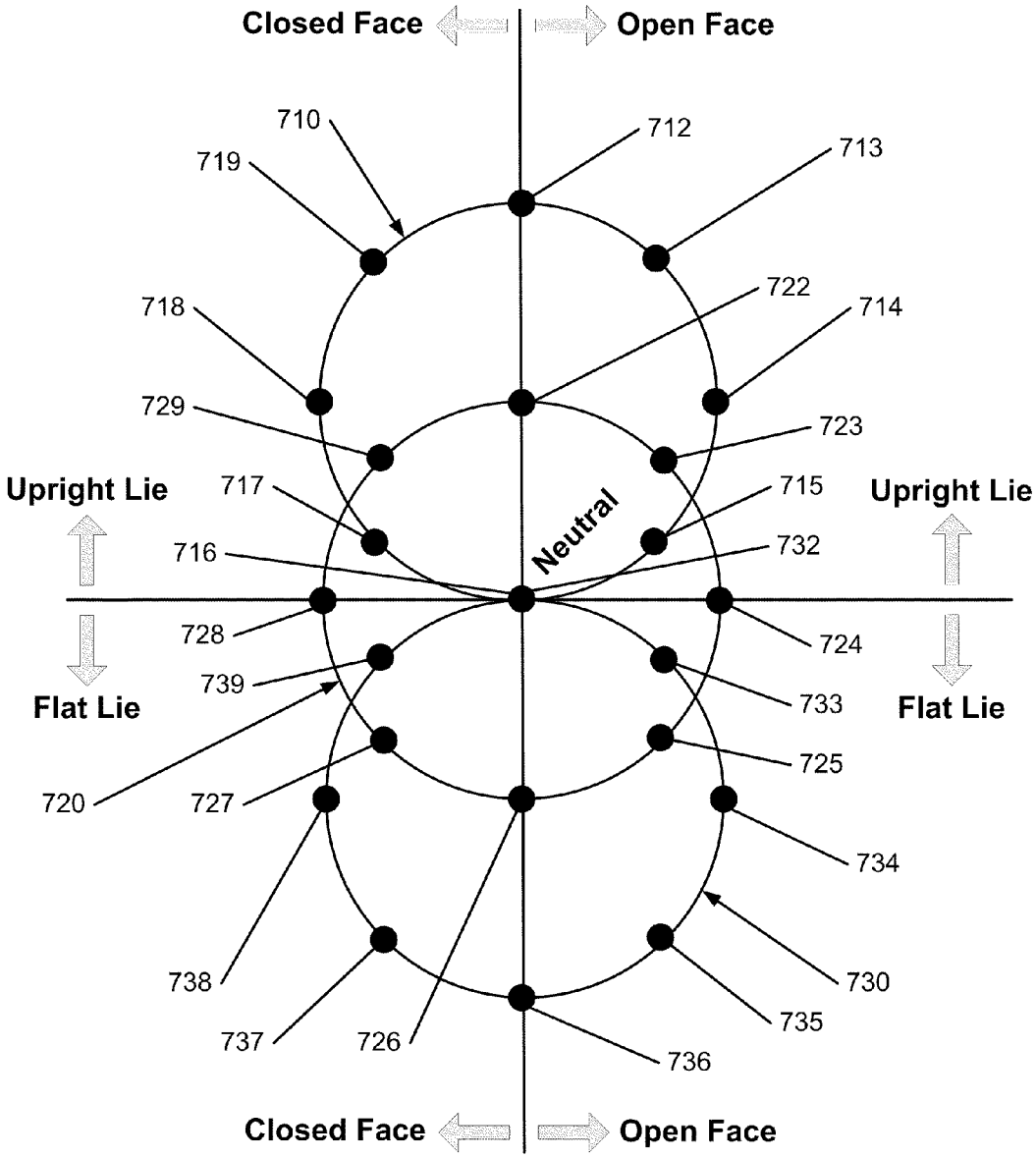
Figure 8:
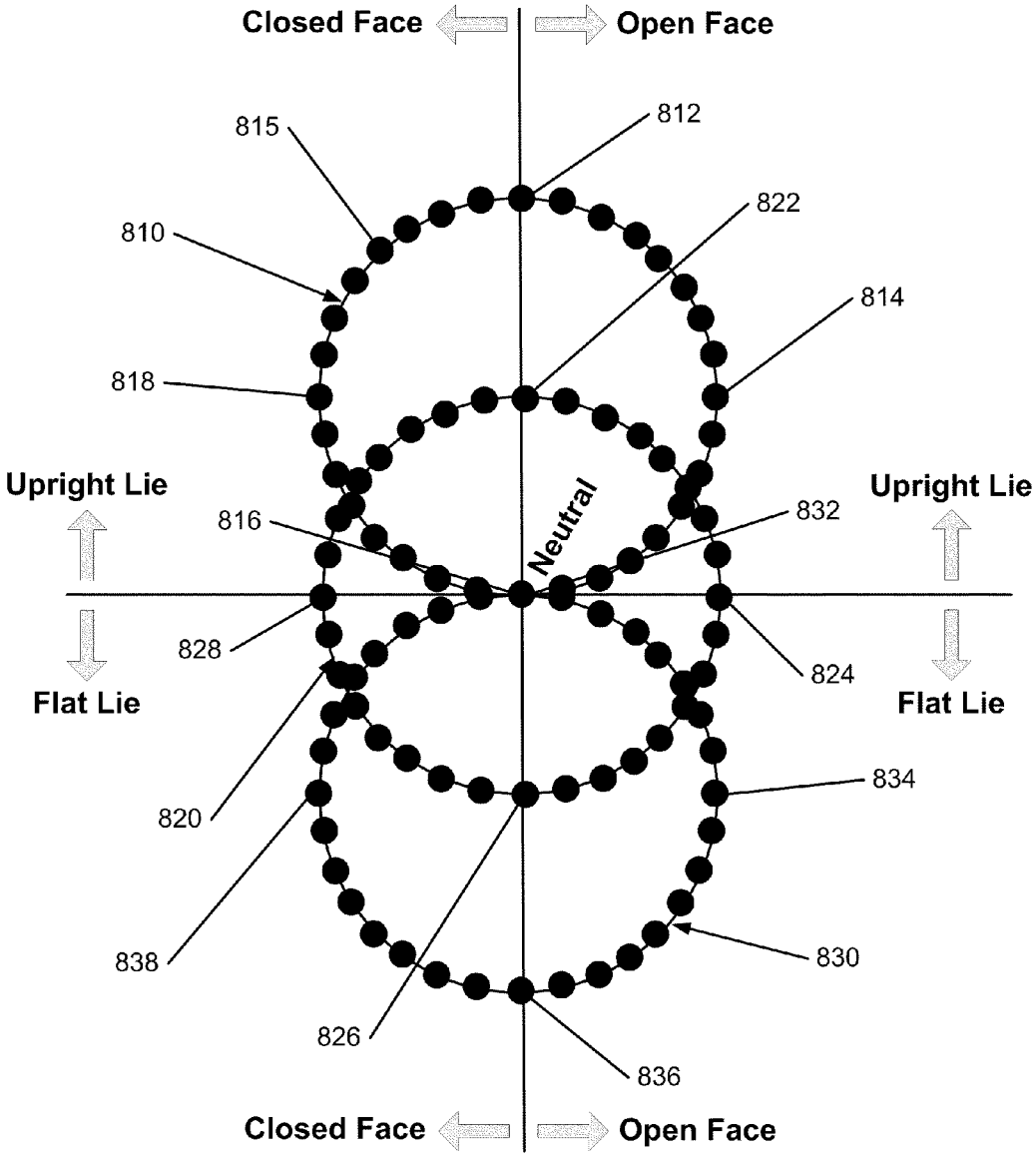

FIGS. 6 through 8 illustrate graphical representations of potential adjustment positions for a 3-sleeve insert system as described above. The dots on the circles represent the position of an offset shaft adapter 200 as it rotates 360 degrees in each of the respective sleeve inserts. The releasable connection system illustrated in FIG. 6 includes a rotation-inhibiting structure on the shaft adapter 200 and/or the sleeve insert 500 that allows the shaft adapter 200 to rotate in 4 different positions as the shaft adapter 200 rotates 360 degrees in the each of the respective sleeve inserts 500A, 500B, 500C, thereby changing the lie angle (upright/flat), loft angle, and/or face angle (open/closed). When the shaft adapter 200 is rotatable in 4 different positions and is used with 3 different sleeve inserts, there are 11 different adjustable positions, as will be explained below and as illustrated in FIG. 6. FIG. 6 represents the various adjustment positions possible using a 4-position, offset angle shaft adapter 200, the neutral sleeve insert 500A, the offset upright sleeve insert 500B, and the offset flat sleeve insert 500C. The dots on the top circle 610 represent the potential adjustment positions of the shaft adapter 200 with the offset upright sleeve insert 500B. The dots on the middle circle 620 represent the potential adjustment positions of the shaft adapter with the neutral sleeve insert 500A. The dots on the bottom circle 630 represent the potential adjustment positions of the shaft adapter 200 with the offset flat sleeve insert 500C. As shown, the positions attainable with one sleeve insert may partially overlap with positions attainable with one or more other sleeve inserts.

As illustrated in FIG. 6, as an exemplary configuration utilizing a 4-position, 2-degree offset angle shaft adapter 200, the neutral sleeve insert 500A, the 2-degree offset upright sleeve insert 500B, and the 2-degree offset flat sleeve insert 500C, the following positions may be selected. While using the 2-degree offset upright sleeve insert 500B (the top circle 610), the shaft adapter 200 may be rotated to: 1) a 4-degree upright position 612; 2) a 2-degree open, 2-degree upright position 614; 3) a neutral position 616; and 4) a 2-degree closed, 2-degree upright position 618. Additionally, when using the neutral sleeve insert 500A (the middle circle 620), the shaft adapter 200 may be rotated to: 1) a 2-degree upright position 622, 2) a 2-degree open position 624, 3) a 2-degree flat position 626, and 4) a 2-degree closed position 628. Finally, when using the 2-degree offset flat sleeve insert 500C (the bottom circle 630), the shaft adapter 200 may be rotated to: 1) a neutral position 632; 2) a 2-degree open, 2-degree flat position 634; 3) a 4-degree flat position 636; and 4) a 2-degree closed, 2-degree flat position 638. Overall, with this example structure, this releasable connection system includes 11 different potential adjustment positions (the same neutral position is available using two of the inserts).

In another similar structure, the shaft adapter 200 may be configured to rotate to 8 different positions with respect to the sleeve insert. For example, the splines on the shaft adapter 200 may allow the shaft adapter 200 to rotate to 8 different positions as the shaft adapter 200 rotates 360 degrees in the sleeve insert 500, thereby changing the lie angle (upright/flat), loft angle, and/or face angle (open/closed). When the shaft adapter 200 is rotatable in 8 different positions and used with 3 different sleeve inserts, there are 23 different adjustable positions, as will be explained below and as illustrated in FIG. 7. FIG. 7 represents the various adjustment positions possible using an 8-position, offset angle shaft adapter 200, the neutral sleeve insert 500A, the offset upright sleeve insert 500B, and the offset flat sleeve insert 500C. The dots on the top circle 710 represent the potential adjustment positions of the shaft adapter 200 with the offset upright sleeve insert 500B. The dots on the middle circle 720 represent the potential adjustment positions of the shaft adapter with the neutral sleeve insert 500A. The dots on the bottom circle 730 represent the potential adjustment positions of the shaft adapter 200 with the offset flat sleeve insert 500C.

As illustrated in FIG. 7, as an exemplary configuration utilizing an 8-position, 2-degree offset angle shaft adapter 200, the neutral sleeve insert 500A, the 2-degree offset upright sleeve insert 500B, and the 2-degree offset flat sleeve insert 500C, the following positions may be selected. While using the 2-degree offset upright sleeve insert 500B (the top circle 710), the shaft adapter 200 may be rotated to: 1) a 4-degree upright position 712; 2) an approximately 1-degree open, 3-degree upright position 713; 3) a 2-degree open, 2-degree upright position 714; 4) an approximately 1-degree open, 0.75-degree upright position 715; 5) a neutral position 716; 6) an approximately 1-degree closed, 0.75-degree upright position 717; 7) a 2-degree closed, 2-degree upright position 718; and 8) an approximately 1-degree closed, 3-degree upright position 719. Additionally, when using the neutral sleeve insert 500A (the middle circle 720), the shaft adapter 200 may be rotated to: 1) a 2-degree upright position 722; 2) an approximately 1-degree open, 1.5-degree upright position 723; 3) a 2-degree open position 724; 4) an approximately 1-degree open, 1.5-degree flat position 725; 5) a 2-degree flat position 726 6) an approximately 1-degree closed, 1.5-degree flat position 727; 7) a 2-degree closed position 728; and 8) an approximately 1-degree closed, 1.5-degree upright position 729. Finally, when using the 2-degree offset flat sleeve insert 500C (the bottom circle 730), the shaft adapter 200 may be rotated to: 1) a neutral position 732; 2) an approximately 1-degree open, 0.75-degree flat position 733; 3) a 2-degree open, 2-degree flat position 734; 4) an approximately 1-degree open, 3-degree flat position 735; 5) a 4-degree flat position 736; 6) an approximately 1-degree closed, 3-degree flat position 737; 7) a 2-degree closed, 2-degree flat position 738; and 8) an approximately 1-degree closed, 0.75-degree flat position 739. For example, as illustrated by position 715, the shaft adapter 200 may be positioned in an approximately 1 degree open face angle, and an approximately 3 degree upright lie angle position. Overall, with this example structure, this releasable connection system includes 23 different potential adjustment positions.

In another similar arrangement, the shaft adapter 200 may be configured to rotate to 32 different positions with respect to the sleeve insert 500. For example, the splines on the shaft adapter 200 may allow the shaft adapter 200 to rotate in 32 different positions as the shaft adapter 200 rotates 360 degrees in the sleeve insert 500, thereby changing the lie angle (upright/flat), loft angle, and/or face angle (open/closed). When the shaft adapter 200 is rotatable to 32 different positions and used with 3 different sleeve inserts, there are 95 different adjustable positions are available, as will be explained below and as illustrated in FIG. 8. FIG. 8 represents the various adjustment positions possible using a 32-position, offset angle shaft adapter 200, the neutral sleeve insert 500A, the offset upright sleeve insert 500B, and the offset flat sleeve insert 500C. The dots on the top circle 810 represent the potential adjustment positions of the shaft adapter 200 with the offset upright sleeve insert 500B. The dots on the middle circle 820 represent the potential adjustment positions of the shaft adapter 200 with the neutral sleeve insert 500A. The dots on the bottom circle 830 represent the potential adjustment positions of the shaft adapter 200 with the offset flat sleeve insert 500C.

As illustrated in FIG. 8, as an example configuration utilizing a 32-position, 2-degree offset angle shaft adapter 200, the neutral sleeve insert 500A, the 2-degree offset upright sleeve insert 500B, and the 2-degree offset flat sleeve insert 500C, the following positions may be selected. While using the 2-degree offset upright sleeve insert 500B (the top circle 810), the shaft adapter 200 may be rotated to: 1) a 4-degree upright position 812; 2) a 2-degree open, 2-degree upright position 814; 3) a neutral position 816; and 4) a 2-degree closed, 2-degree upright position 818. Additionally, when using the neutral sleeve insert 500A (the middle circle 820), the shaft adapter 200 may be rotated to: 1) a 2-degree upright position 822, 2) a 2-degree open position 824, 3) a 2-degree flat position 826, and 4) a 2-degree closed position 828. Finally, when using the 2-degree offset flat sleeve insert 500C (the bottom circle 830), the shaft adapter 200 may be rotated to: 1) a neutral position 832; 2) a 2-degree open, 2-degree flat position 834; 3) a 4-degree flat position 836; and 4) a 2-degree closed, 2-degree flat position 838. In addition, the shaft adapter 200 may be positioned or adjusted to positions in between all of the above described positions. For example, as illustrated by position 815, the shaft adapter 200 may be positioned in an approximately 1-degree closed face angle, and an approximately 3-degree upright lie angle position. Overall, with this example structure, this releasable connection system may include approximately 95 different potential adjustment positions.

In other structures similar to those described above with respect to FIGS. 5A through 5C with three different sleeve inserts, the releasable connection system may include any number of different sleeve inserts. For example, the releasable connection system may include five different sleeve inserts, the same three sleeve inserts described above and illustrated as reference numbers 500A, 500B, and 500C and two additional sleeve inserts. The two additional sleeve inserts may include an offset angle for the face angle. For example, one additional sleeve insert may have an open face offset angle and a second additional sleeve insert may have a closed face offset angle. The releasable connection system may include a neutral sleeve insert, an upright lie sleeve insert, a flat lie sleeve insert, an open face angle sleeve insert, and a closed face angle sleeve insert.

Figure 9:
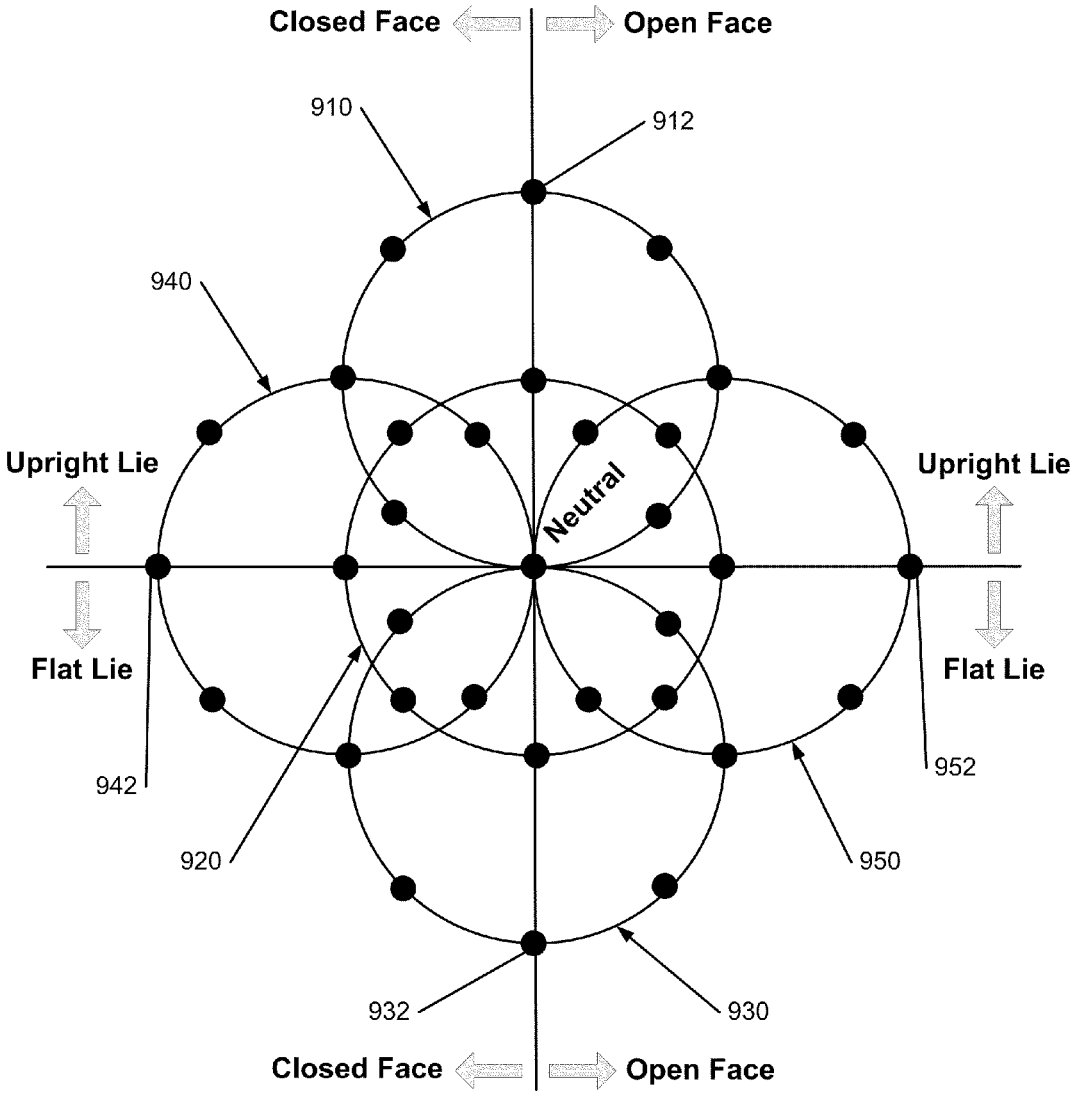

In this example arrangement, as was described above, the shaft adapter 200 with an offset angle 232 may provide a first axis of adjustment. Additionally, the five different sleeve inserts may be interchanged to provide a second and independent axis of adjustment. Using the 8-position splined shaft adapter as described above, the shaft adapter 200 rotates to 8 different positions as the shaft adapter rotates 360 degrees in the sleeve insert, thereby changing the lie angle (upright/flat), loft angle, and/or face angle (open/closed). FIG. 9 represents the various adjustment positions possible using an 8-position, offset angle shaft adapter, a neutral sleeve insert, an upright lie sleeve insert, a flat lie sleeve insert, an open face angle sleeve insert, and a closed face angle sleeve insert. The dots on the top circle 910 represent the potential adjustment positions of the shaft adapter with the offset upright lie sleeve insert. The dots on the middle circle 920 represent the potential adjustment positions of the shaft adapter with the neutral sleeve insert. The dots on the bottom circle 930 represent the potential adjustment positions of the shaft adapter with the offset flat lie sleeve insert. The dots on the left circle 940 represent the potential adjustment positions of the shaft adapter with the offset closed face angle sleeve insert. The dots on the right circle 950 represent the potential adjustment positions of the shaft adapter with the offset open face angle sleeve insert.

As illustrated in FIG. 9, with an example configuration utilizing an 8-position, 2-degree offset angle shaft adapter, a neutral sleeve insert, a 2-degree offset upright lie sleeve insert, a 2-degree offset flat lie sleeve insert, a 2-degree offset open face angle sleeve insert, and a 2-degree offset closed face angle sleeve insert, the following positions may be selected. While using the 2-degree offset upright sleeve insert (the top circle 910), the shaft adapter may be rotated to a 4-degree upright position 912. Also, while using the 2-degree offset flat upright sleeve insert (the bottom circle 930), the shaft adapter may be rotated to a 4-degree flat position 932. While using the 2-degree closed face angle sleeve insert (the left circle 940), the shaft adapter may be rotated to a 4-degree closed face angle position 942. Finally, while using the 2-degree open face angle sleeve insert (the right circle 950), the shaft adapter may be rotated to a 4-degree open face angle position 952. Additionally, other potential adjustment positions, as represented by the dots on the circles 910, 920, 930, 940, 950 in FIG. 9, are available with various shaft adapter rotations and sleeve insert combinations. Overall, with this example structure, this releasable connection system includes 33 different potential adjustment positions.

Figure 10A:
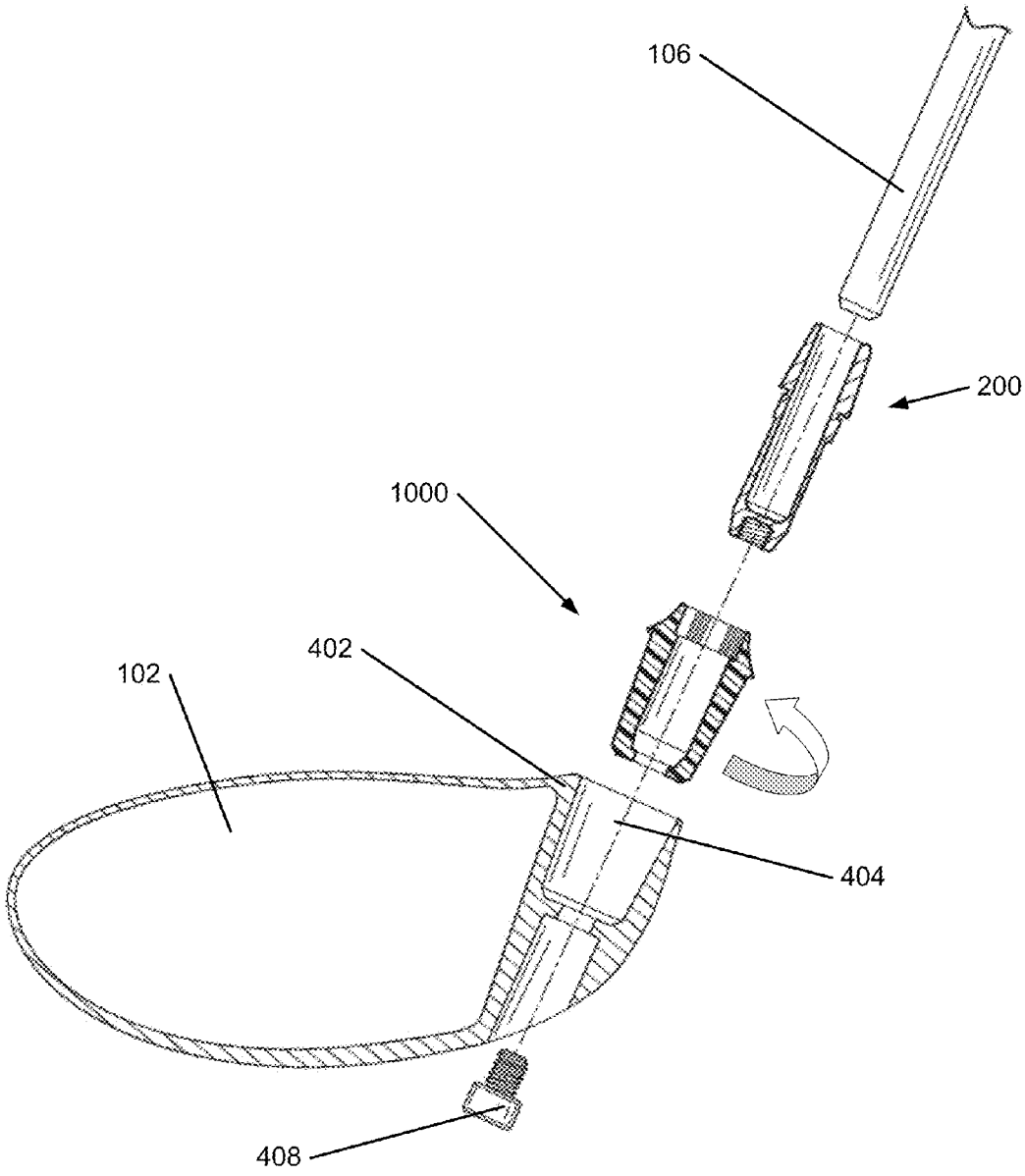
FIG. 10A illustrates a cutaway view of a golf club utilizing another example golf club head/shaft connection member/system in accordance with examples of this invention.

As another example, without departing from this invention, the releasable connection system may include a sleeve insert that is reversible (i.e., orientable at two positions 180 degrees apart. As illustrated in FIG. 10A, the releasable connection system may include a shaft adapter 200 that is inserted into a reversible sleeve insert 1000. The sleeve insert 1000 may then be inserted into the club head hosel area 402 and the club head chamber 404, wherein the securing member 408 secures the shaft adapter 200 and the sleeve insert 1000 in place within the club head 102. The securing member 408 may then be loosened such that the sleeve insert 1000 may be rotated and/or reversed positions. The securing member 408 may then be tightened to again secure the rotated and/or reversed sleeve insert 1000 into place within the club head 102. The reversible sleeve insert 1000 may include multiple keys or tabs (similar to those illustrated in FIG. 4B) in order to lock the sleeve insert 1000 in the club head chamber 404 in one of two locations (if desired, multiple structure may be included to enable the sleeve insert 1000 to be securable to the club head chamber in more than just two discrete orientations, such as four, eight, or more orientations). The reversible sleeve insert 1000 may be 180 degrees reversible within the club head chamber 404. Thereby, if the reversible sleeve insert 1000 includes a face angle offset, the reversible sleeve insert 1000 may be reversible between an open face angle offset and a closed face angle offset. Similarly, if the reversible sleeve insert 1000 includes a lie angle offset, the reversible sleeve insert 1000 may be reversible between an upright lie angle offset and a flat lie angle offset.

Figure 10B:
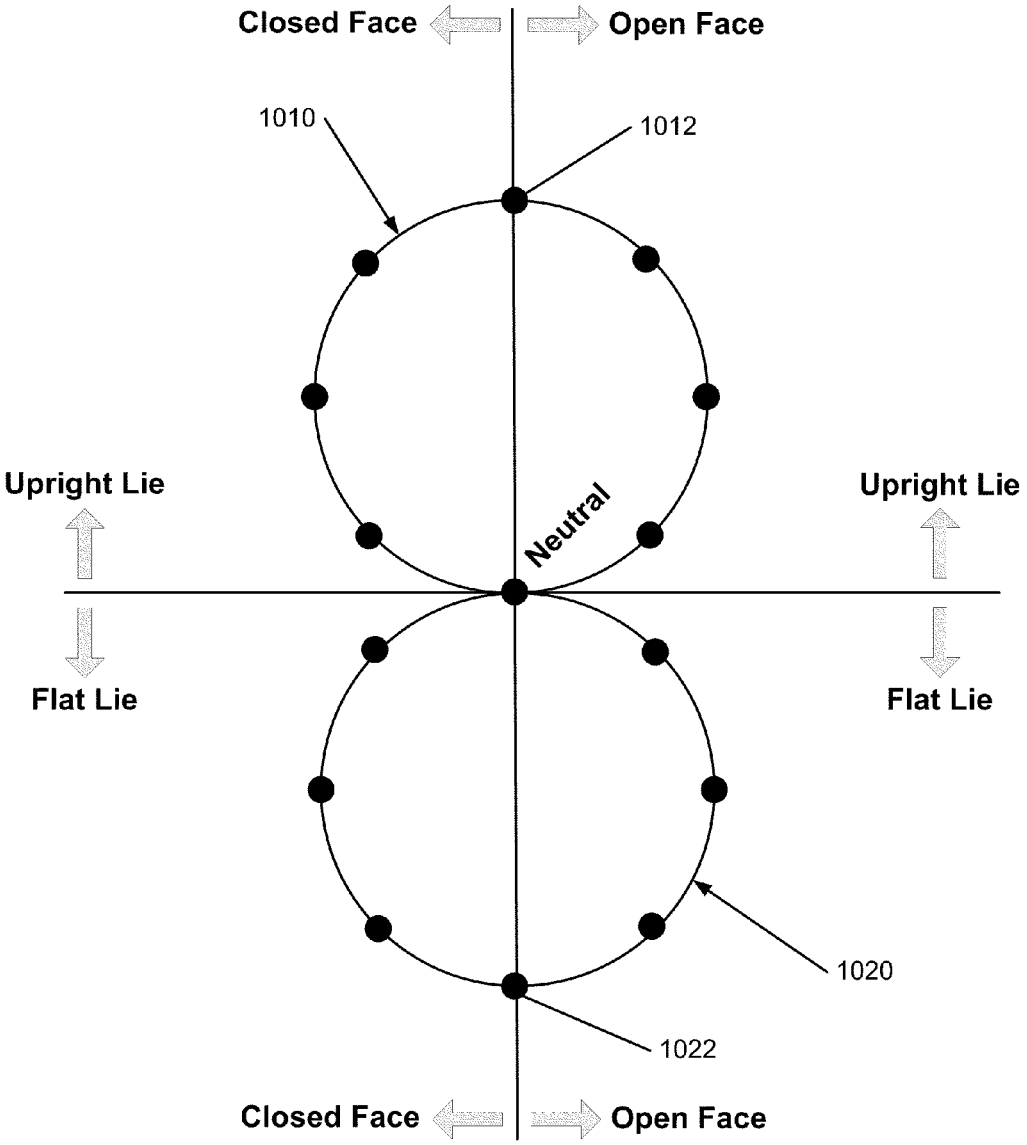
FIG. 10B illustrates a schematic that represents potential adjustment positions for a golf club when using the example releasable connection system illustrated in FIG. 10A in accordance with examples of this invention.

FIG. 10B illustrates the potential adjustment positions available using the reversible sleeve insert 1000 as described above. For example, FIG. 10A illustrates an offset shaft adapter 200 rotatable to 8 different positions with a lie angle reversible sleeve insert 1000. The top circle 1010 represents the reversible sleeve insert 1000 in the upright lie position while the bottom circle 1020 represents the reversible sleeve insert 1000 in the flat lie position. For example, using a 1.5-degree offset shaft adapter 200 and a 1.5-degree offset reversible sleeve insert in the upright lie position (the top circle 1010), the shaft adapter 200 may be rotated to a 3-degree upright lie position 1012. Other potential adjustment positions are represented by the other dots located along the top circle 1010. Additionally, if the sleeve insert 1000 is removed and rotated/reversed to the flat lie position (the bottom circle 1020), the shaft adapter 200 may be rotated to a 3-degree flat lie position 1022. Other potential adjustment positions are represented by the other dots located along the bottom circle 1020. Overall, with this example structure, this releasable connection system includes 15 different potential adjustment positions.

Figure 11A:
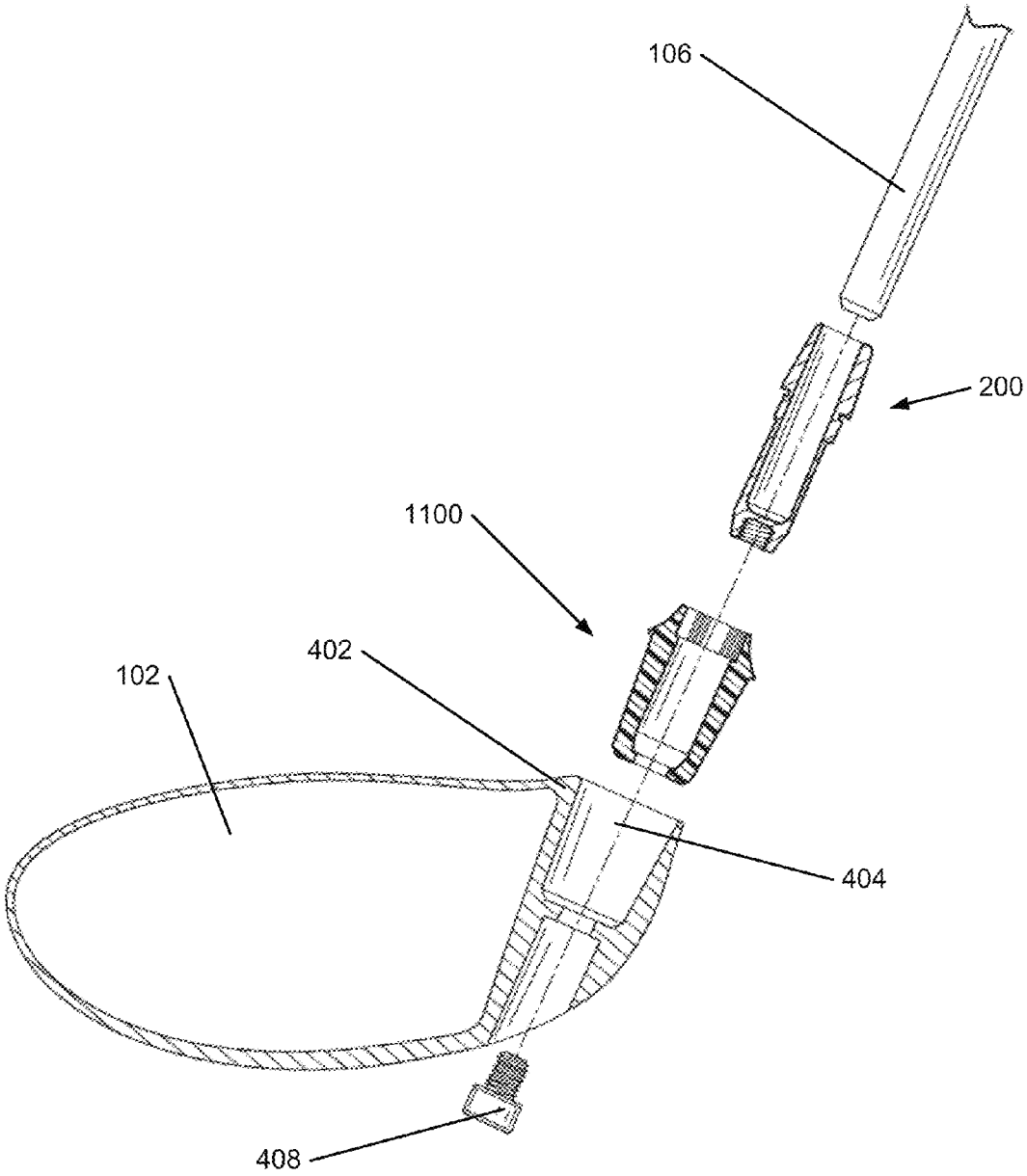
FIGS. 11A and 11B illustrate various views of a golf club utilizing another example golf club head/shaft connection member/system in accordance with examples of this invention.
Figure 11B:
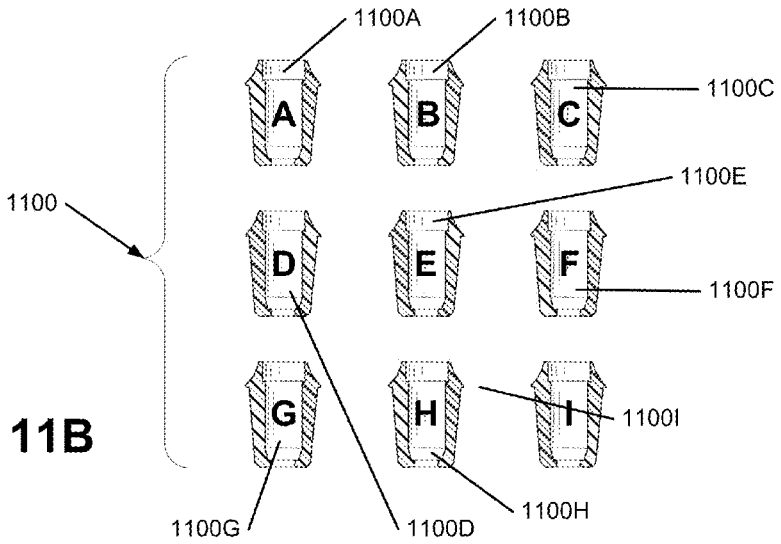

In another example structure in accordance with this invention, the releasable connection system may include multiple independent sleeve inserts that yield pre-determined angle settings. In this example structure, as illustrated in FIGS. 11A and 11B, the releasable connection system may include a shaft adapter 200 with zero angle offset that is inserted into a first sleeve insert 1100A which is part of a set of sleeve inserts 1100. The first sleeve insert 1100A may then be inserted into the club head hosel area 402 and the club head chamber 404, wherein a securing member 408 secures the shaft adapter 200 and the first sleeve insert 1100A in place within the club head 102. The securing member 408 may then be loosened such that the first sleeve insert 1100A may be removed and replaced with a different and second sleeve insert 1100B. The securing member 408 may then be tightened to secure the second sleeve insert 1100B into place within the club head 102. The first sleeve insert 1100A and the second sleeve insert 1100B may have differing pre-determined angle settings. An example of differing sleeve inserts for the above releasable connection system is illustrated in FIGS. 11B and 11C.

Figure 11C:
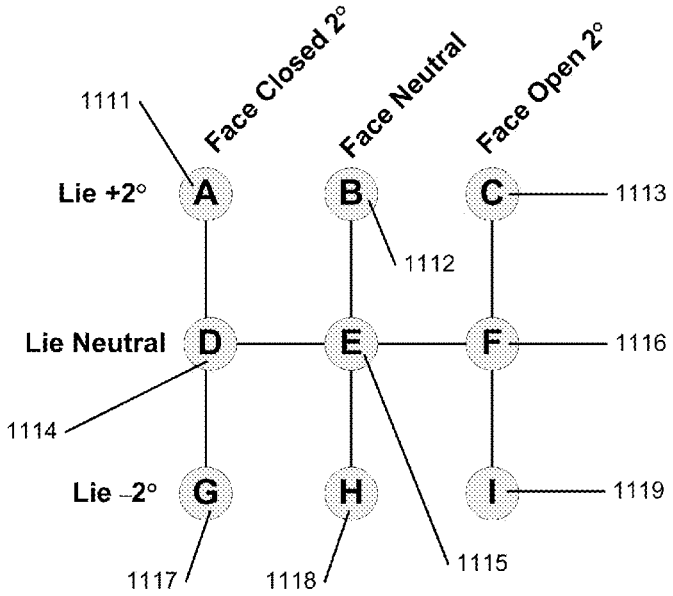
FIG. 11C illustrates a schematic that represents potential adjustment positions for a golf club when using the example releasable connection system illustrated in FIGS. 11A and 11B in accordance with examples of this invention.

As illustrated in FIGS. 11B and 11C, the releasable connection system may include nine different, independent sleeve inserts 1100A through 1100I that provide pre-determined angle settings. FIG. 11B illustrates the nine different sleeve inserts. FIG. 11C illustrates nine potential different adjustable positions or angle settings, one for each of the different sleeve inserts. For example, the sleeve insert A 1100A yields a position 1111 on the club head 102 with a 2-degree upright lie angle and a 2-degree closed face angle. The sleeve insert B 1100B yields a position 1112 on the club head 102 with a 2-degree upright lie angle and a neutral face angle. The sleeve insert C 1100C yields a position 1113 on the club head 102 with a 2-degree upright lie angle and a 2-degree open face angle. The sleeve insert D 1100D yields a position 1114 on the club head 102 with a neutral lie angle and a 2-degree closed face angle. The sleeve insert E 1100E yields a position 1115 on the club head 102 with a neutral lie angle and a neutral face angle. The sleeve insert F 1100F yields a position 1116 on the club head 102 with a neutral lie angle and a 2-degree open face angle. The sleeve insert G 1100G yields a position 1117 on the club head 102 with a 2-degree flat lie angle and a 2-degree closed face angle. The sleeve insert H 1100H yields a position 1118 on the club head 102 with a 2-degree flat lie angle and a neutral face angle. Lastly, the sleeve insert I 1100I yields a position 1119 on the club head 102 with a 2-degree flat lie angle and a 2-degree open face angle. It is understood that any number of different, independent sleeve inserts with any number of pre-determined angle settings may be included with the releasable connection system described above without departing from this invention. While the above configuration was described with a shaft adapter 200 with zero offset angle, a shaft adapter with an offset angle may be utilized with this example arrangement without departing from this invention.

Figure 12:
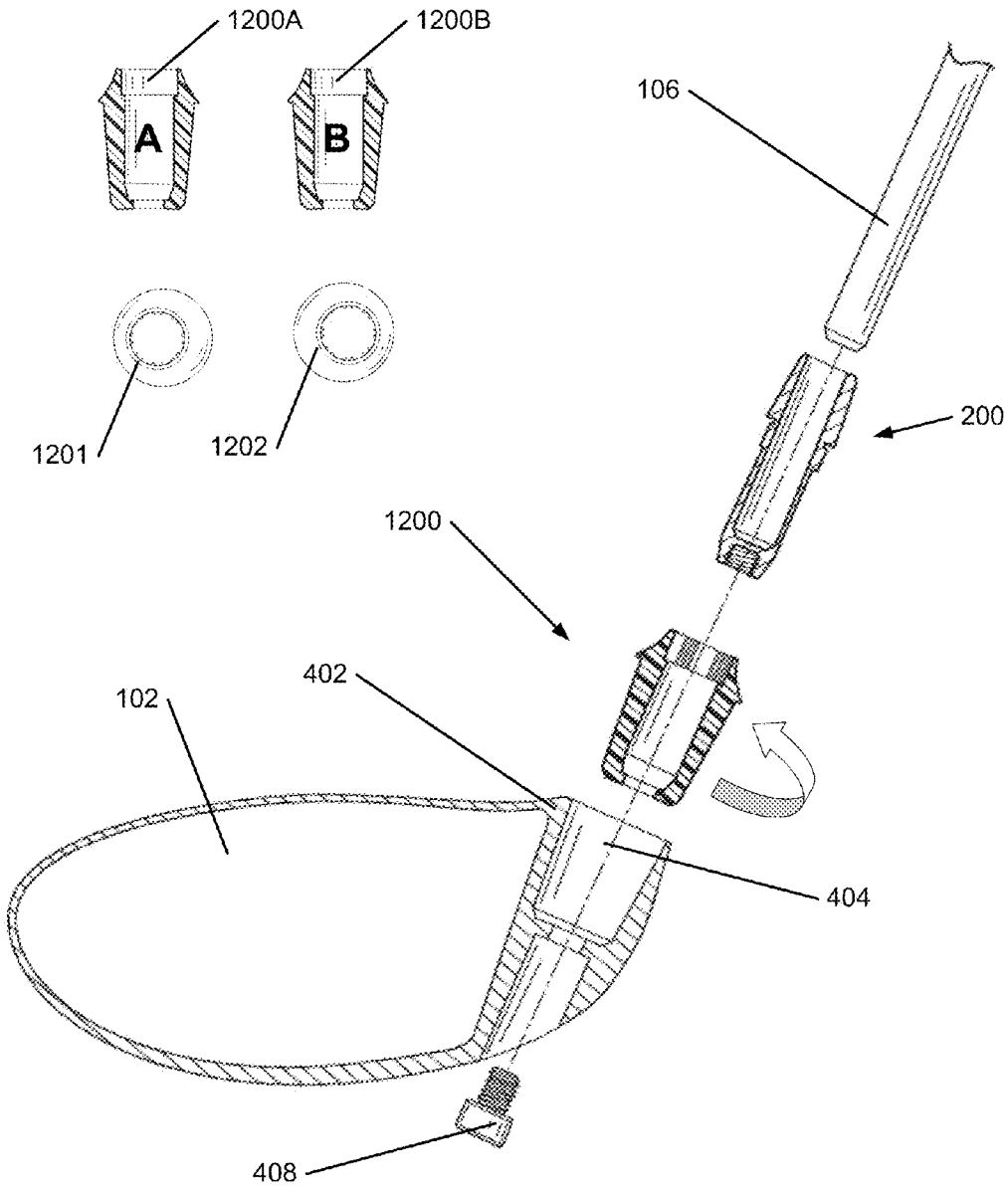
FIG. 12 illustrates various views of a golf club utilizing another example golf club head/shaft connection member/system in accordance with examples of this invention.

In another example of a releasable connection system according to this invention, the releasable connection system may include multiple independent, reversible sleeve inserts. Each reversible sleeve insert may yield two different pre-determined angle settings. In this example arrangement, as illustrated in FIG. 12, the releasable connection system may include a shaft adapter 200 with zero angle offset that is inserted into a first sleeve insert 1200A which is part of a set of sleeve inserts 1200. The sleeve inserts 1200 may be 180 degrees reversible, such that the sleeve inserts 1200 have a first orientation 1201 and a second orientation 1202 (illustrated by showing a top view of a reversible sleeve insert in each of the two orientations). The first sleeve insert 1200A may then be inserted into the club head hosel area 402 and the club head chamber 404 in a first orientation (one of two different orientations 180 degrees apart). A securing member 408 then secures the shaft adapter 200 and the first sleeve insert 1200A in place within the club head 102. The securing member 408 may then be loosened such that the first sleeve insert 1200A may be removed. The first sleeve insert 1200A may then be rotated to the second orientation 1202 or the first sleeve insert 1200A may be replaced with a different and second sleeve insert 1200B. The securing member 408 may then be tightened to secure either the first sleeve insert 1200A or the second sleeve insert 1100B into place within the club head 102. The first sleeve insert 1200A and the second sleeve insert 1200B may have differing pre-determined angle settings. Additionally, because the sleeve inserts 1200 are reversible, each sleeve insert has two different pre-determined angle settings. In this example, it is understood that any number of different, independent reversible sleeve inserts 1200 with any number of pre-determined angle settings may be included with the releasable connection system described above without departing from this invention. While the above configuration was described with a shaft adapter 200 with zero offset angle, a shaft adapter with an offset angle may be utilized with this example system without departing from this invention.

Additionally, other rotation-inhibiting structures may be utilized with the shaft adapter and sleeve insert combination without departing from this invention. FIGS. 13A through 16B illustrate different example configurations of the rotation-inhibiting structures on the shaft adapter and the sleeve insert. The rotation-inhibiting structures 212, 312 described above includes splines, and the rotation-inhibiting structure on the shaft adapter allows the shaft adapter to rotate to 8 different positions as the shaft adapter rotates 360 degrees in the sleeve insert.

Figure 13A:
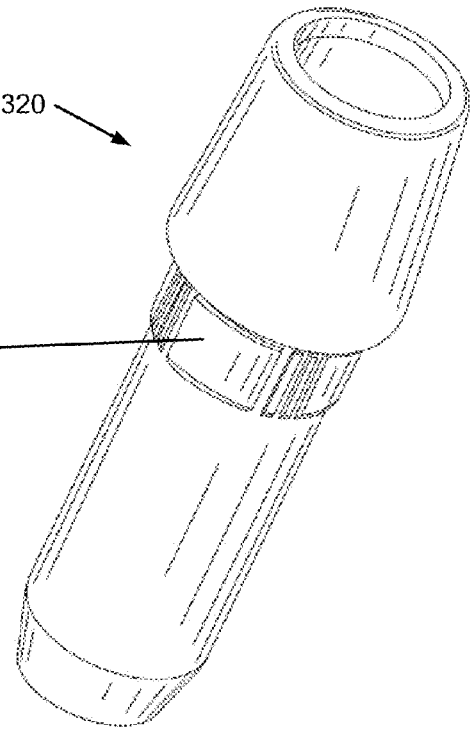
FIGS. 13A through 16B illustrate various views of other example golf club/shaft connection members that may be used in accordance with examples of this invention.
Figure 13B:
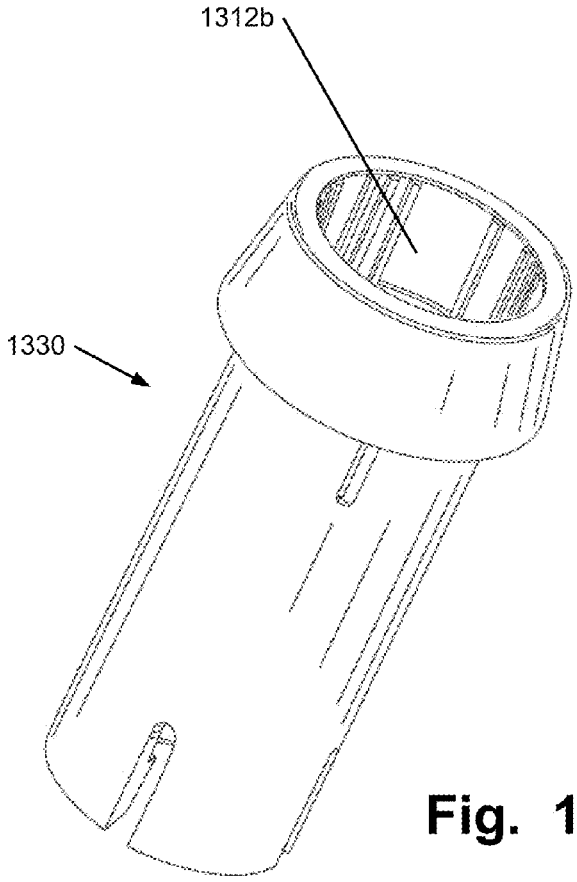

As illustrated in FIGS. 13A and 13B, the rotation-inhibiting structures 1312*a* on the shaft adapter 1320 and the rotation-inhibiting structures 1312*b* on the sleeve insert 1330 are again splines, however, the rotation-inhibiting structures 1312*a* on the shaft adapter 1320 cooperating with the rotation-inhibiting structures 1312*b* on the sleeve insert 1330 allow the shaft adapter 1320 to rotate to 4 different positions as the shaft adapter 1320 rotates 360 degrees in the sleeve insert 1330. Additionally, in other example arrangements according to this invention, the rotation-inhibiting structures 1412*a* on the shaft adapter 1420 cooperate with the rotation-inhibiting structures 1412*b* on the sleeve insert 1430 to allow the shaft adapter 1420 to rotate to 16 different positions (not illustrated) or 32 different positions (illustrated in FIGS. 14A and 14B) as the shaft adapter 1420 rotates 360 degrees in the sleeve insert 1430.

Figure 14A:
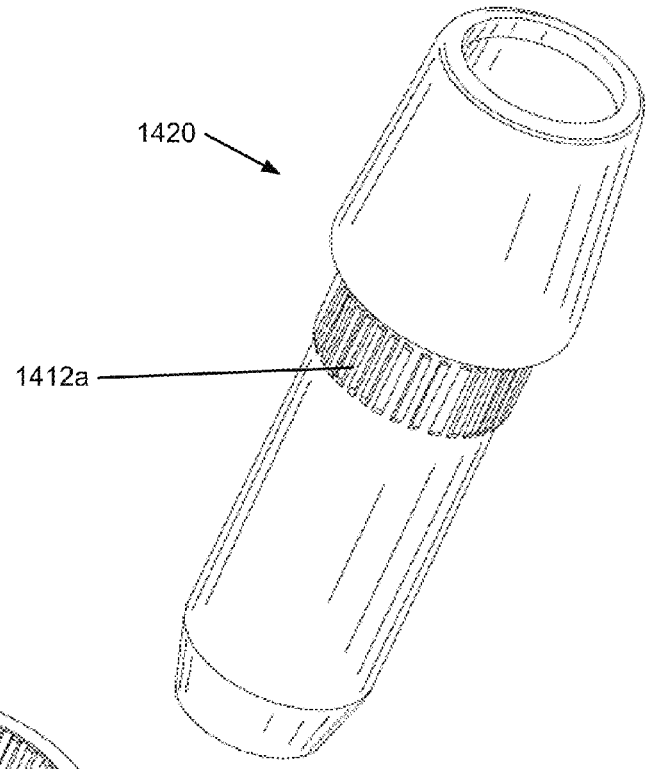
Figure 14B:
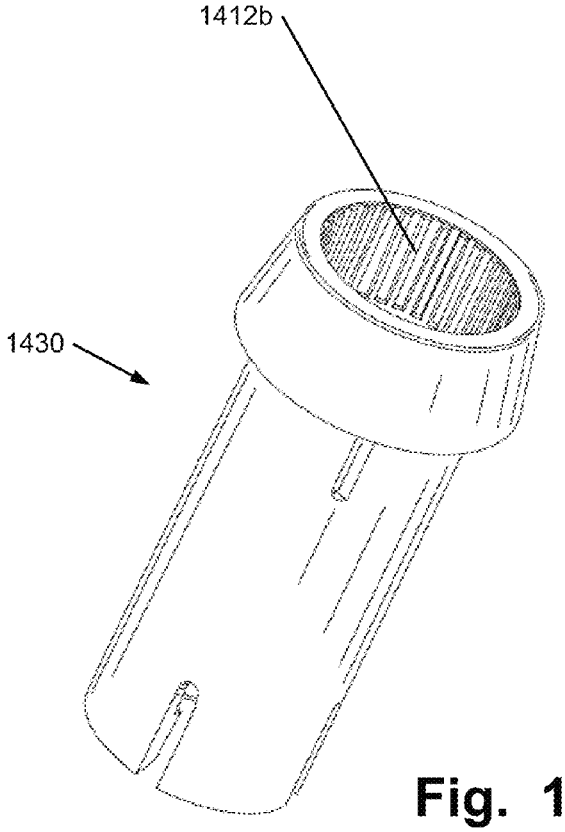

The rotation-inhibiting structures also may be configured such that the second rotation-inhibiting structure on the sleeve insert can accept the first rotation-inhibiting structure on both the 8-position splined shaft adapter 300 illustrated in FIG. 2A and the 32-position splined shaft adapter 1430 illustrated in FIG. 14B. This design is described in more detail in U.S. patent application Ser. No. 12/509,231 filed Jul. 24, 2009 in the name of Raymond Sander, which is incorporated herein in its entirety.

Figure 15A:
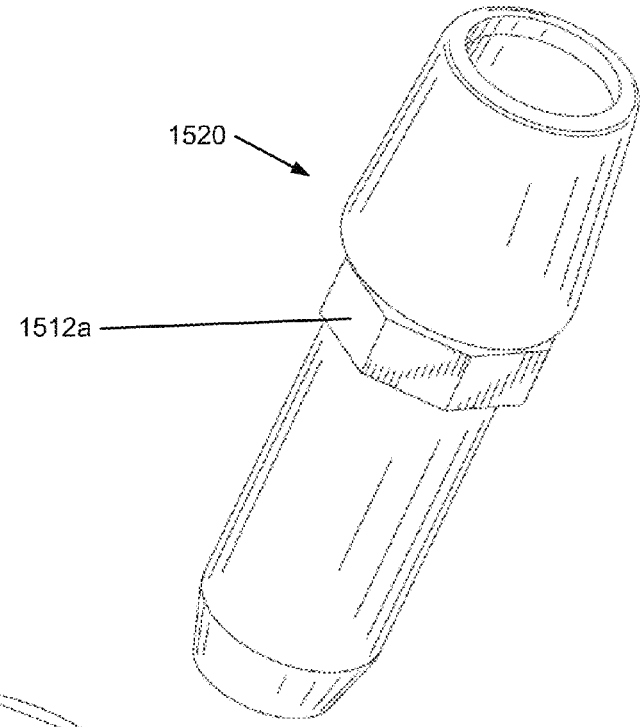
Figure 15B:
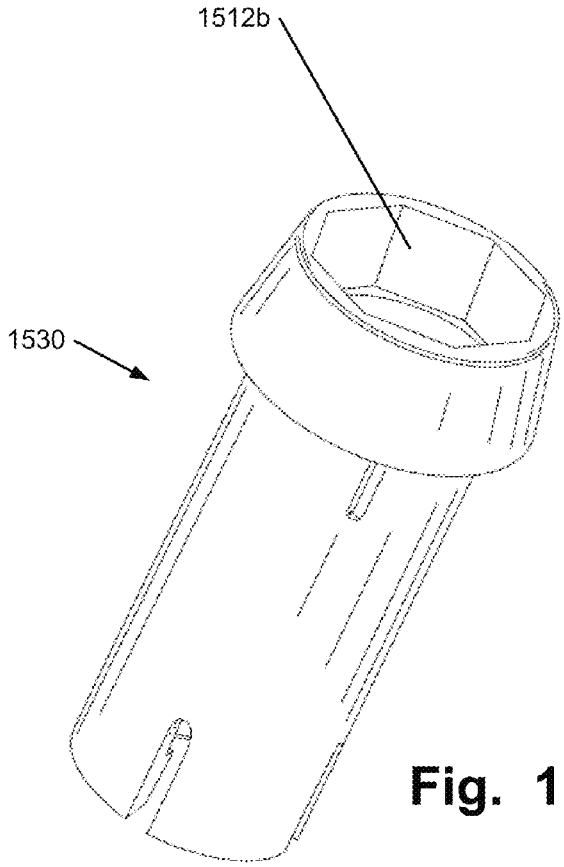

Additionally, as illustrated in FIGS. 15A and 15B, instead of the splines, in another example of the invention, the shaft adapter 1520 may include a first rotation-inhibiting structure 1512*a* that includes a cylindrical area having a non-round cross section and the sleeve insert 1530 may include a second rotation-inhibiting structure 1512*b* that includes a non-round cross section that matches with or otherwise engages the first rotation-inhibiting structure 1512*a*. While a variety of non-rounded cross sectional structures may be used without departing from the invention, in the illustrated example, the first rotation-inhibiting structure 1512*a* and second rotation-inhibiting structure 1512*b* have a polygon shaped cross section having plural flat sides.

In addition to the first rotation-inhibiting structure 1512*a*, the second rotation-inhibiting structure 1512*b* on the sleeve insert 1530 may include an opening with a plurality of flat sides or edges that generally correspond to the size, shape, and location of the first rotation-inhibiting structure 1512*a* (and flat panels) of the shaft adapter 1520 (e.g., having a non-round opening, and in this illustrated example, a polygonal opening with flat sides or edges). As illustrated in FIGS. 15A and 15B, the first rotation-inhibiting structure 1512*a* on the shaft adapter 1520 and the second rotation-inhibiting structure 1512*b* on the sleeve insert may include eight flat sides or edges.

Figure 16A:
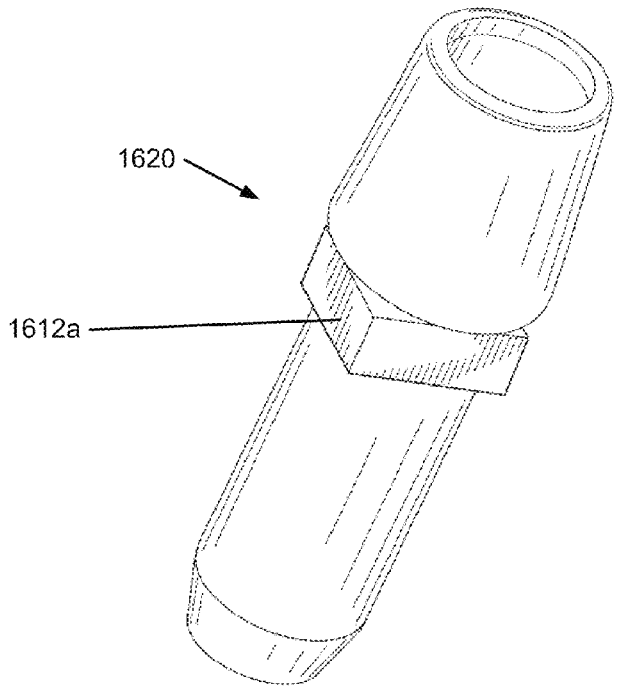
Figure 16B:
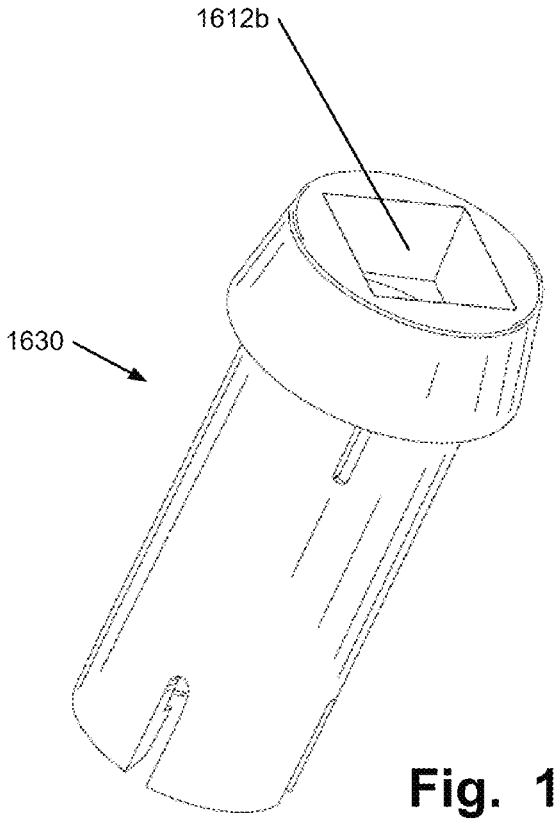

Without departing from the invention, as illustrated in FIGS. 16A and 16B, the first rotation-inhibiting structure 1612*a* on the shaft adapter 1620 and the second rotation-inhibiting structure 1612*b* on the sleeve insert 1630 may include four flat sides or edges. Furthermore, without departing from this invention, in other examples, the first rotation-inhibiting structure 1612*a* on the shaft adapter 1620 and the second rotation-inhibiting structure 1612*b* on the sleeve insert 1630 may include other numbers of flat sides or edges, such as five, six, ten, twelve, sixteen or more.

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head/shaft connection assembly, comprising:

a first cylindrical structure having a first end and a second end opposite the first end, wherein the first end includes a first opening that defines a cylindrical interior chamber for receiving a golf club shaft, wherein an exterior surface of the cylindrical structure nearer to the first end than the second end includes a first rotation-inhibiting structure, and wherein the second end includes a securing structure;

a second cylindrical structure having a first end and a second end opposite the first end, wherein the first end defines an opening to a borehole for receiving the first cylindrical structure, wherein an interior surface of the second cylindrical structure nearer to the first end than the second end includes a second rotation-inhibiting structure, wherein an outer cylindrical surface of the second cylindrical structure extends in a first axial direction and the interior cylindrical surface of the borehole extends in a second axial direction that differs from the first axial direction, thereby creating a face angle offset for the second cylindrical structure, and further wherein the second cylindrical structure is reversible and orientable in two positions 180 degrees apart between an open face angle offset and a closed face angle offset; and a securing system for releasably engaging the securing structure.

2. A golf club head/shaft connection assembly according to claim 1, wherein the securing structure includes a threaded hole defined in the second end of the first cylindrical structure and the securing system includes a threaded bolt element that engages the threaded hole.

3. A golf club head/shaft connection assembly according to claim 2, wherein the second end of the second cylindrical structure defines a second opening for receiving the securing member, wherein the second opening is sized such that the threaded bolt element is able to pass through the second opening so that the threaded bolt element engages the threaded hole in the first cylindrical structure.

4. A golf club head/shaft connection assembly according to claim 1, wherein the first rotation-inhibiting structure includes splines and the second rotation-inhibiting structure includes splines.

5. A golf club head/shaft connection assembly according to claim 1, wherein the first rotation-inhibiting structure engages the second rotation-inhibiting structure to prevent rotation of the first cylindrical structure with respect to the second cylindrical structure.

6. A golf club head/shaft connection assembly according to claim 1, wherein the first rotation-inhibiting structure extends less than 35% of an overall axial length of the first cylindrical structure.

7. A golf club head/shaft connection assembly according to claim 1, wherein the second rotation-inhibiting structure extends less than 35% of an overall axial length of the second cylindrical structure.

8. A golf club head/shaft connection assembly according to claim 1, wherein the exterior surface of the first cylindrical structure extends in a first axial direction and the cylindrical interior chamber extends in a second axial direction that differs from the first axial direction, thereby creating an offset angle for the first cylindrical structure.

9. A golf club head/shaft connection assembly according to claim 1, wherein the exterior surface of the second cylindrical structure and the borehole are not coaxial.

10. A golf club head/shaft connection assembly, comprising:

a first cylindrical structure having a first end and a second end opposite the first end, wherein the first end includes a first opening that defines a cylindrical interior chamber for receiving a golf club shaft, wherein an exterior surface of the cylindrical structure nearer to the first end than the second end includes a first rotation-inhibiting structure, and wherein the second end includes a securing structure;

a second cylindrical structure having a first end and a second end opposite the first end, wherein the first end defines an opening to a borehole for receiving the first cylindrical structure, wherein an interior surface of the second cylindrical structure nearer to the first end than the second end includes a second rotation-inhibiting structure, wherein an outer cylindrical surface of the second cylindrical structure extends in a first axial direction and the interior cylindrical surface of the borehole extends in a second axial direction that differs from the first axial direction, thereby creating a lie angle offset for the second cylindrical structure, and further wherein the second cylindrical structure is reversible and orientable in two positions 180 degrees apart between an upright lie angle offset and a flat lie angle offset; and a securing system for releasably engaging the securing structure.

11. A golf club head/shaft connection assembly according to claim 10, wherein the securing structure includes a threaded hole defined in the second end of the first cylindrical structure and the securing system includes a threaded bolt element that engages the threaded hole.

12. A golf club head/shaft connection assembly according to claim 10, wherein the first rotation-inhibiting structure includes splines and the second rotation-inhibiting structure includes splines.

13. A golf club head/shaft connection assembly according to claim 10, wherein the first rotation-inhibiting structure engages the second rotation-inhibiting structure to prevent rotation of the first cylindrical structure with respect to the second cylindrical structure.

14. A golf club head/shaft connection assembly according to claim 10, wherein the second end of the second cylindrical structure defines a second opening for receiving the securing member, wherein the second opening is sized such that the threaded bolt element is able to pass through the second opening so that the threaded bolt element engages the threaded hole in the first cylindrical structure.

15. A golf club head/shaft connection assembly according to claim 10, wherein the first rotation-inhibiting structure extends less than 35% of an overall axial length of the first cylindrical structure.

16. A golf club head/shaft connection assembly according to claim 10, wherein the second rotation-inhibiting structure extends less than 35% of an overall axial length of the second cylindrical structure.

17. A golf club head/shaft connection assembly according to claim 10, wherein the exterior surface of the first cylindrical structure extends in a first axial direction and the cylindrical interior chamber extends in a second axial direction that differs from the first axial direction, thereby creating an offset angle for the first cylindrical structure.

18. A golf club head/shaft connection assembly according to claim 10, wherein the exterior surface of the second cylindrical structure and the borehole are not coaxial.

* * * * *